US011756477B2

(12) United States Patent
Song et al.

(10) Patent No.: US 11,756,477 B2
(45) Date of Patent: Sep. 12, 2023

(54) GATE DRIVER AND DISPLAY DEVICE INCLUDING THE SAME

(71) Applicant: Samsung Display Co., Ltd., Yongin-si (KR)

(72) Inventors: Heerim Song, Seoul (KR); Gyungsoon Park, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/720,288

(22) Filed: Apr. 13, 2022

(65) Prior Publication Data

US 2022/0335878 A1 Oct. 20, 2022

(30) Foreign Application Priority Data

Apr. 14, 2021 (KR) ..... 10-2021-0048228

(51) Int. Cl.
*G09G 3/3266* (2016.01)
*G09G 3/30* (2006.01)

(52) U.S. Cl.
CPC ..... *G09G 3/30* (2013.01); *G09G 2300/0426* (2013.01); *G09G 2300/0876* (2013.01)

(58) Field of Classification Search
CPC ..... G09G 3/30; G09G 2300/0426; G09G 2300/0876; G09G 2300/0814; G09G 2300/0819; G09G 2300/0842; G09G 2300/0861; G09G 2310/0205; G09G 2310/0221; G09G 2310/04; G09G 2340/0435; G09G 3/3266; G09G 3/3233; G09G 3/32; G09G 2300/043; G09G 2330/028
See application file for complete search history.

(56) References Cited

U.S. PATENT DOCUMENTS

| | | | | |
|---|---|---|---|---|
| 9,633,608 | B2 | 4/2017 | Shin | |
| 9,887,256 | B2 | 2/2018 | Kim et al. | |
| 10,504,442 | B2 | 12/2019 | Yoo | |
| 10,553,166 | B2 * | 2/2020 | Seo | G09G 3/3677 |
| 10,762,852 | B2 * | 9/2020 | Jung | G09G 3/3233 |

(Continued)

FOREIGN PATENT DOCUMENTS

| | | |
|---|---|---|
| KR | 10-2015-0069850 | 6/2015 |
| KR | 10-2019-0003334 | 1/2019 |
| KR | 10-2021-0055133 | 5/2021 |

*Primary Examiner* — Ibrahim A Khan
(74) *Attorney, Agent, or Firm* — H.C. Park & Associates, PLC

(57) ABSTRACT

A gate driver includes at least one stage, which includes: a first output circuit configured to supply a voltage of a first power source or a voltage of a second power source to a first output terminal and including a fourth capacitor connected between a second node and the first output terminal; a second output circuit configured to supply a signal supplied to a fourth input terminal or the voltage of the second power source to a second output terminal; an input circuit configured to control a voltage of the second node and a voltage of a third node; a first signal processor configured to control a voltage of a first node; a second signal processor configured to control the voltage of the second node; and a third signal processor connected between the first node and the third node, and configured to control the voltage of the first node.

28 Claims, 18 Drawing Sheets

(56) References Cited

U.S. PATENT DOCUMENTS

| | | | | |
|---|---|---|---|---|
| 11,024,258 | B2 * | 6/2021 | Jeong | G09G 3/3266 |
| 11,270,629 | B2 * | 3/2022 | Yu | G09G 3/32 |
| 11,308,857 | B2 * | 4/2022 | In | G09G 3/3674 |
| 11,436,979 | B2 * | 9/2022 | Kim | G09G 3/3233 |
| 11,545,080 | B2 * | 1/2023 | Yu | G09G 3/32 |
| 2012/0182050 | A1 * | 7/2012 | Yang | G09G 3/3266 327/109 |
| 2014/0320479 | A1 | 10/2014 | Kaneko et al. | |
| 2017/0186373 | A1 * | 6/2017 | Nishikawa | G09G 3/3258 |
| 2018/0284551 | A1 * | 10/2018 | Shim | G02F 1/136286 |
| 2019/0005884 | A1 * | 1/2019 | Yoo | G06F 3/011 |
| 2019/0180834 | A1 * | 6/2019 | Yuan | G09G 3/3677 |
| 2020/0020266 | A1 * | 1/2020 | Feng | G11C 19/28 |
| 2020/0066212 | A1 * | 2/2020 | Kim | G09G 3/3233 |
| 2020/0135286 | A1 * | 4/2020 | Li | G09G 3/3266 |
| 2021/0134925 | A1 | 5/2021 | Choi et al. | |
| 2021/0201767 | A1 * | 7/2021 | Park | G09G 3/3233 |
| 2021/0233446 | A1 * | 7/2021 | Zhu | G09G 3/035 |
| 2021/0383760 | A1 * | 12/2021 | In | G09G 3/3266 |
| 2023/0005430 | A1 * | 1/2023 | Li | G09G 3/2096 |

* cited by examiner

GATE DRIVER AND DISPLAY DEVICE INCLUDING THE SAME

CROSS-REFERENCE TO RELATED APPLICATIONS

This application claims priority to and the benefit of Korean Patent Application No. 10-2021-0048228, filed Apr. 14, 2021, which is hereby incorporated by reference for all purposes as if fully set forth herein.

BACKGROUND

Field

One or more embodiments generally relate to a display device, and, more particularly, to a gate driver capable of providing various gate signals and a display device including the same.

Discussion

A display device may include a display panel for displaying an image and a driver for controlling the image displayed via the display panel. The driver may include a data driver providing data voltages to the display panel, a gate driver providing gate signals to the display panel, and/or the like. The gate driver may include a plurality of stages for respectively supplying the gate signals to the display panel. Each of the stages may include a plurality of transistors and a plurality of capacitors.

The above information disclosed in this section is only for understanding the background of the inventive concepts, and, therefore, may contain information that does not form prior art.

SUMMARY

One or more embodiments provide a gate driver capable of providing a normal compensation gate signal.

One or more embodiments provide a display device capable of preventing recognition of a dark line.

Additional aspects will be set forth in the detailed description which follows, and, in part, will be apparent from the disclosure, or may be learned by practice of the inventive concepts.

According to an embodiment, a gate driver includes at least one stage. The at least one stage includes a first output circuit, a second output circuit, an input circuit, a first signal processor, a second signal processor, and a third signal processor. The first output circuit is configured to supply a voltage of a first power source or a voltage of a second power source to a first output terminal in response to a voltage of a first node and a voltage of a second node. The first output circuit includes a fourth capacitor connected between the second node and the first output terminal. The second output circuit is configured to supply a signal supplied to a fourth input terminal or the voltage of the second power source to a second output terminal in response to the voltage of the first node and the voltage of the second node. The input circuit is configured to control the voltage of the second node in response to a signal supplied to a first input terminal and a signal supplied to a second input terminal. The first signal processor is configured to control the voltage of the first node in response to the voltage of the second node. The second signal processor is configured to control a voltage of a third node in response to the signal supplied to the first input terminal. The third signal processor is connected between the first node and the third node. The third signal processor is configured to control the voltage of the first node in response to an output voltage of the second signal processor and a signal supplied to a third input terminal.

According to an embodiment, a display device includes a display panel and a gate driver. The display panel includes a first display area configured to be driven at a first frequency, a second display area configured to be driven at a second frequency different from the first frequency, and a third display area positioned between the first display area and the second display area. The gate driver includes at least one first stage configured to provide a first gate signal to the first display area, at least one second stage configured to provide the first gate signal to the second display area, and at least one third stage configured to provide the first gate signal to the third display area. Each of the at least one first stage, the at least one second stage, and the at least one third stage includes a first output circuit, a second output circuit, an input circuit, a first signal processor, a second signal processor, and a third signal processor. The first output circuit is configured to supply a voltage of a first power source or a voltage of a second power source to a first output terminal in response to a voltage of a first node and a voltage of a second node. The second output circuit is configured to supply a signal supplied to a fourth input terminal or the voltage of the second power source to a second output terminal in response to the voltage of the first node and the voltage of the second node. The input circuit is configured to control the voltage of the second node in response to a signal supplied to a first input terminal and a signal supplied to a second input terminal. The first signal processor is configured to control the voltage of the first node in response to the voltage of the second node. The second signal processor is configured to control a voltage of a third node in response to the signal supplied to the first input terminal. The third signal processor is connected between the first node and the third node. The third signal processor is configured to control the voltage of the first node in response to an output voltage of the second signal processor and a signal supplied to a third input terminal. The first output circuit of the at least one third stage includes a fourth capacitor connected between the second node and the first output terminal.

According to an embodiment, a display device includes a display panel and a gate driver. The display panel includes a first display area configured to be driven at a first frequency, a second display area configured to be driven at a second frequency different from the first frequency, and a third display area positioned between the first display area and the second display area. The gate driver includes at least one first stage configured to provide a first gate signal to the first display area, at least one second stage configured to provide the first gate signal to the second display area, and at least one third stage configured to provide the first gate signal to the third display area. Each of the at least one first stage, the at least one second stage, and the at least one third stage includes a first output circuit, a second output circuit, an input circuit, a first signal processor, a second signal processor, and a third signal processor. The first output circuit is configured to supply a voltage of a first power source or a voltage of a second power source to a first output terminal in response to a voltage of a first node and a voltage of a second node. The second output circuit is configured to supply a signal supplied to a fourth input terminal or the voltage of the second power source to a second output terminal in response to the voltage of the first node and the voltage of the second node. The input circuit is configured to control the voltage of the second node in response to a signal supplied to a first input terminal and a signal supplied to a second input terminal. The first signal processor is configured to control the voltage of the first node in response to the voltage of the second node. The second signal processor is configured to control a voltage of a third node in response to the signal supplied to the first input terminal. The second signal processor includes a third capacitor connected between the first power source and the second node. The third signal processor is connected between the first node and the third node. The third signal processor is configured to control the voltage of the first node in response to an output voltage of the second signal processor and a signal supplied to a third input terminal. A capacitance of the third capacitor of the at least one third stage is greater than a capacitance of the third capacitor of each of the at least one first stage and the at least one second stage.

According to various embodiments, a gate-off level of a compensation gate signal may be maintained without being raised while an initialization gate signal maintains a gate-off level, thereby providing a normal compensation gate signal to a third display area.

According to various embodiments, a normal compensation gate signal may be provided, thereby preventing a dark line from being recognized in a third display area.

The foregoing general description and the following detailed description are illustrative and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

DETAILED DESCRIPTION OF SOME EMBODIMENTS

Figure 1:
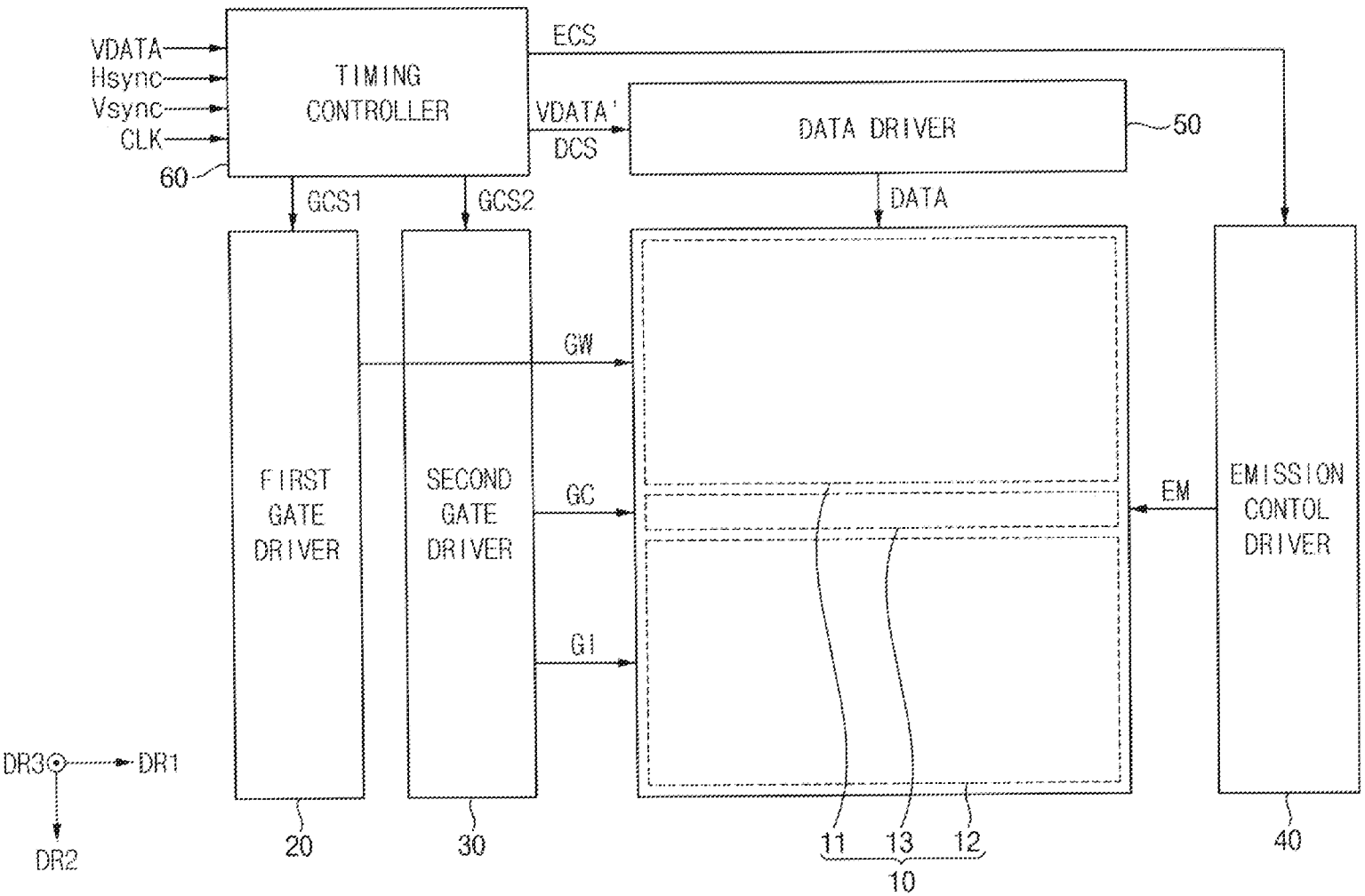
FIG. 1 is a block diagram illustrating a display device according to an embodiment.

In the following description, for the purposes of explanation, numerous specific details are set forth in order to provide a thorough understanding of various embodiments. As used herein, the terms "embodiments" and "implementations" may be used interchangeably and are non-limiting examples employing one or more of the inventive concepts disclosed herein. It is apparent, however, that various embodiments may be practiced without these specific details or with one or more equivalent arrangements. In other instances, well-known structures and devices are shown in block diagram form to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing example features of varying detail of some embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. In addition, the DR1-axis, the DR2-axis, and the DR3-axis are not limited to three axes of a rectangular coordinate system, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing some embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various embodiments are described herein with reference to sectional views, isometric views, perspective views, plan views, and/or exploded illustrations that are schematic illustrations of idealized embodiments and/or intermediate structures. As such, variations from the shapes of the illustrations as a result of, for example, manufacturing techniques and/or tolerances, are to be expected. Thus, embodiments disclosed herein should not be construed as limited to the particular illustrated shapes of regions, but are to include deviations in shapes that result from, for instance, manufacturing. To this end, regions illustrated in the drawings may be schematic in nature and shapes of these regions may not reflect the actual shapes of regions of a device, and, as such, are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the inventive concepts. Further, the blocks, units, and/or modules of some embodiments may be physically combined into more complex blocks, units, and/or modules without departing from the inventive concepts.

Hereinafter, various embodiments will be explained in detail with reference to the accompanying drawings.

FIG. 1 is a block diagram illustrating a display device according to an embodiment.

Referring to FIG. 1, a display device may include a display panel 10, a first gate driver 20, a second gate driver 30, an emission control driver 40, a data driver 50, and a timing controller 60. A plurality of pixels may be disposed in the display panel 10. The pixels may be arranged in a first direction DR1 and a second direction DR2 crossing the first direction DR1. In an embodiment, the first direction DR1 may be a pixel row direction, and the second direction DR2 may be a pixel column direction. A third direction DR3 may be perpendicular to the first and second directions DR1 and DR2, and, in this manner, may represent a thickness direction of, for instance, the display panel 10.

The display panel 10 may include a plurality of pixel rows. In an embodiment, the display panel 10 may include first to 2560-th pixel rows. However, embodiments are not limited thereto, and the display panel 10 may include nay suitable numbers of pixel rows.

The display panel 10 may include a first display area 11, a second display area 12, and a third display area 13. The second display area 12 may be positioned in the second direction DR2 from the first display area 11. The third display area 13 may be positioned between the first display area 11 and the second display area 12.

Each of the first display area 11, the second display area 12, and the third display area 13 may include at least one pixel row. In an embodiment, the first display area 11 may include first to 1270-th pixel rows, the second display area 12 may include 1281-th to 2560-th pixel rows, and the third display area 13 may include 1271-th to 1280-th pixel rows. However, embodiments are not limited thereto, and each of the first display area 11, the second display area 12, and the third display area 13 may include any suitable number of pixel rows.

The first display area 11 may be driven at a first frequency. The second display area 12 may be driven at a second frequency different from the first frequency. In an embodiment, the first frequency may be greater than the second frequency. For example, the first frequency may be 120 Hz, and the second frequency may be 1 Hz.

In an embodiment, the third display area 13 may be driven at the first frequency. In other words, a driving frequency of the third display area 13 may be the same as a driving frequency of the first display area 11, but embodiments are not limited thereto.

The timing controller 60 may receive image data VDATA, a horizontal synchronization signal Hsync, a vertical synchronization signal Vsync, and a clock signal CLK. The timing controller 60 may process the image data VDATA to generate image data VDATA' compensated to be suitable for image display via the display panel 10. The timing controller 60 may provide the compensated image data VDATA' to the data driver 50. Further, the timing controller 60 may generate driving control signals GCS1, GCS2, ECS, and DCS for controlling driving of the first gate driver 20, the second gate driver 30, the emission control driver 40, and the data driver 50 based on the horizontal synchronization signal Hsync, the vertical synchronization signal Vsync, and the clock signal CLK. For instance, the timing controller 60 may generate and supply a first gate driving control signal GCS1 to the first gate driver 20, may generate and supply a second gate driving control signal GCS2 to the second gate driver 30, may generate and supply an emission driving control signal ECS to the emission control driver 40, and may generate and supply a data driving control signal DCS to the data driver 50.

The first gate driver 20 may generate a write gate signal GW based on the first gate driving control signal GCS1. The first gate driver 20 may provide the write gate signal GW to the display panel 10. The first gate driver 20 may include a plurality of stages arranged in the second direction DR2.

The second gate driver 30 may generate a first gate signal GC and a second gate signal GI based on the second gate driving control signal GCS2. The second gate driver 30 may provide the first gate signal GC and the second gate signal GI to the display panel 10. In an embodiment, the first gate signal GC and the second gate signal GI may be a compensation gate signal GC and an initialization gate signal GI, respectively. The second gate driver 30 may include a plurality of stages arranged in the second direction DR2.

The emission control driver 40 may generate the emission control signal EM based on the emission driving control signal ECS. The emission control driver 40 may provide the emission control signal EM to the display panel 10. The emission control driver 40 may include a plurality of stages arranged in the second direction DR2.

The data driver 50 may generate a data voltage DATA based on the compensated image data VDATA' and the data driving control signal DCS. The data driver 50 may provide the data voltage DATA to the display panel 10.

Figure 2:
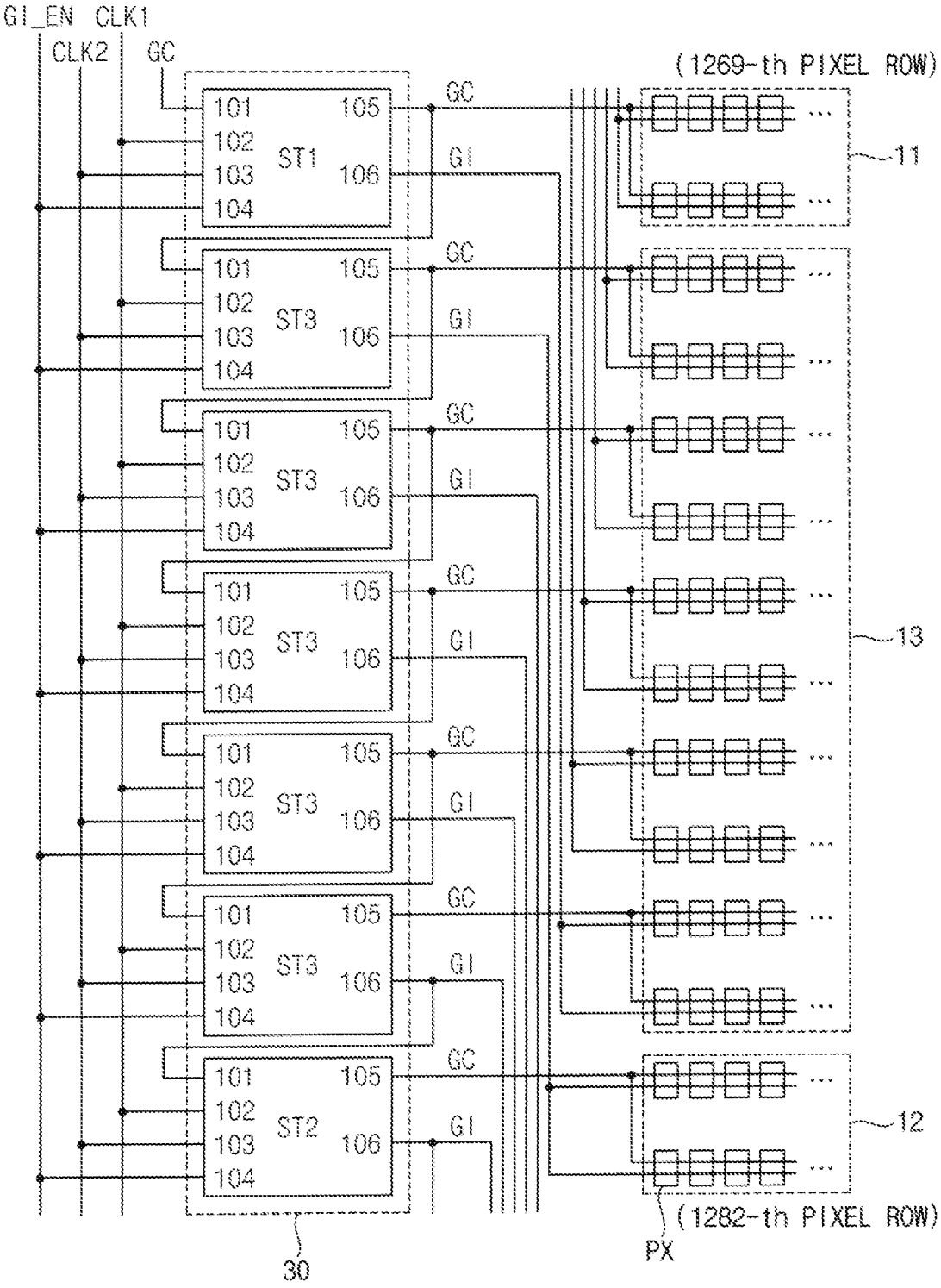
FIG. 2 is a block diagram illustrating a display panel and a second gate driver of the display device in FIG. 1 according to an embodiment.

FIG. 2 is a block diagram illustrating the display panel 10 and the second gate driver 30 of the display device in FIG. 1 according to an embodiment. In FIG. 2, only the 1269-th to 1282-th pixel rows of the display panel 10 and stages ST1, ST2, and ST3 of the second gate driver 30 supplying the compensation gate signals GC thereto are illustrated for convenience of description.

Referring to FIGS. 1 and 2, the second gate driver 30 may include at least one first stage ST1, at least one second stage ST2, and at least one third stage ST3. The first stage ST1 may provide the compensation gate signal GC to the first display area 11, and may provide the initialization gate signal GI to the first display area 11 and the third display area 13. The second stage ST2 may provide the compensation gate signal GC to the second display area 12, and may provide the initialization gate signal GI to the second display area 12. The third stage ST3 may provide the compensation gate signal GC to the third display area 13, and may provide the initialization gate signal GI to the second display area 12.

Each of the stages ST1, ST2, ST3 may include a first input terminal 101, a second input terminal 102, a third input terminal 103, a fourth input terminal 104, a first output terminal 105, and a second output terminal 106.

The first input terminal 101 may receive the compensation gate signal GC or the initialization gate signal GI of a previous stage. The first input terminal 101 of each of the first stage ST1 and the third stage ST3 may receive the compensation gate signal GC of the previous stage, and the first input terminal 101 of the second stage ST2 may receive the initialization gate signal GI of the previous stage.

The second input terminal 102 may receive a first clock signal CLK1. The third input terminal 103 may receive a second clock signal CLK2.

Each of the first clock signal CLK1 and the second clock signal CLK2 may be a square wave signal repeating a logic high level and a logic low level. The first clock signal CLK1 and the second clock signal CLK2 may have a difference of at least half a period. However, the waveform relationship between the first clock signal CLK1 and the second clock signal CLK2 is not necessarily limited thereto.

The fourth input terminal 104 may receive an initialization gate enable signal GI_EN. The initialization gate enable signal GI_EN supplied to the fourth input terminal 104 of the first stage ST1 may be a voltage of a first power source (see VGH in FIG. 4), and the initialization gate enable signal GI_EN supplied to the fourth input terminal 104 of each of the second stage ST2 and the third stage ST3 may be a voltage of a second power source (see VGL in FIG. 4).

The first output terminal 105 may output the compensation gate signal GC. The second output terminal 106 may output the initialization gate signal GI.

Each of the stages ST1, ST2, and ST3 may supply the compensation gate signal GC and the initialization gate signal GI to two adjacent pixel rows. For example, the first stage ST1 may supply the compensation gate signal GC to the 1269-th and 1270-th pixel rows, and may supply the initialization gate signal GI to the 1281-th and 1282-th pixel rows.

Figure 3:
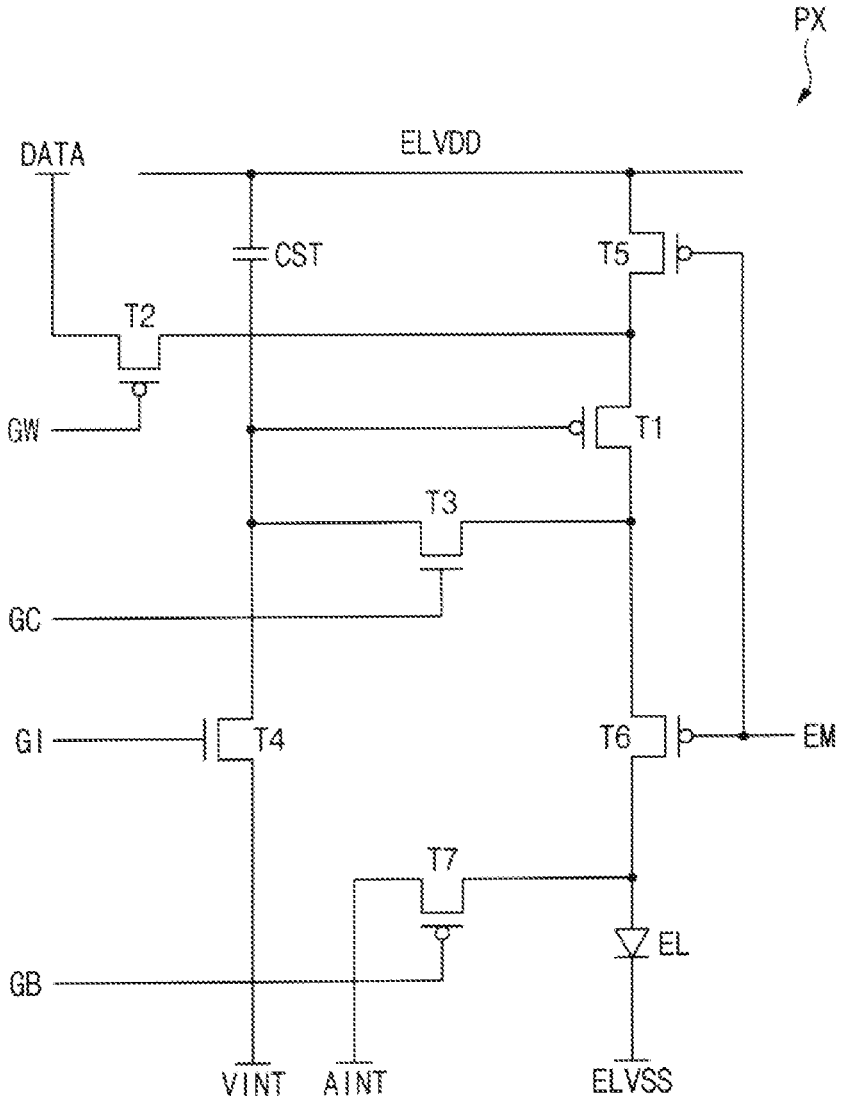
FIG. 3 is a circuit diagram illustrating a pixel of a display panel according to an embodiment.

FIG. 3 is a circuit diagram illustrating a pixel PX of a display panel 10 according to an embodiment.

Referring to FIG. 3, a pixel PX may include first to seventh pixel transistors T1, T2, T3, T4, T5, T6, and T7, a storage capacitor CST, and a light emitting element EL.

The first pixel transistor T1 may be connected between a first pixel power source ELVDD and the light emitting element EL. A gate electrode of the first pixel transistor T1 may be connected to a common node of the storage capacitor CST, the third pixel transistor T3, and the fourth pixel transistor T4. The first pixel transistor T1 may be turned on or off in response to a voltage of the common node.

The second pixel transistor T2 may be connected between a line transmitting the data voltage DATA and the first pixel transistor T1. A gate electrode of the second pixel transistor T2 may receive the write gate signal GW. The second pixel transistor T2 may be turned on or off in response to the write gate signal GW.

The third pixel transistor T3 may be connected between the first pixel transistor T1 and the gate electrode of the first pixel transistor T1. A gate electrode of the third pixel transistor T3 may receive the compensation gate signal GC. The third pixel transistor T3 may be turned on or off in response to the compensation gate signal GC.

The fourth pixel transistor T4 may be connected between a line transmitting a first initialization voltage VINT and the gate electrode of the first pixel transistor T1. A gate electrode of the fourth pixel transistor T4 may receive the initialization gate signal GI. The fourth pixel transistor T4 may be turned on or off in response to the initialization gate signal GI.

The fifth pixel transistor T5 may be connected between the first pixel power source ELVDD and the first pixel transistor T1. A gate electrode of the fifth pixel transistor T5 may receive the emission control signal EM. The fifth pixel transistor T5 may be turned on or off in response to the emission control signal EM.

The sixth pixel transistor T6 may be connected between the first pixel transistor T1 and the light emitting element EL. A gate electrode of the sixth pixel transistor T6 may receive the emission control signal EM. The sixth pixel transistor T6 may be turned on or off in response to the emission control signal EM.

The seventh pixel transistor T7 may be connected between a line transmitting a second initialization voltage AINT and the light emitting element EL. A gate electrode of the seventh pixel transistor T7 may receive the bypass gate signal GB. In an embodiment, when the pixel PX is included in an N-th pixel row, the bypass gate signal GB may be the write gate signal GW applied to the (N+1)-th pixel row. The seventh pixel transistor T7 may be turned on or off in response to the bypass gate signal GB.

In an embodiment, each of the first, second, and fifth to seventh pixel transistors T1, T2, and T5 to T7 may be a p-channel metal-oxide-semiconductor (PMOS) transistor. In such an embodiment, a gate-on voltage of each of the first, second, and fifth to seventh pixel transistors T1, T2, T5 to T7 may be set to a low level, and a gate-off voltage of each of the first, second, and fifth to seventh pixel transistors T1, T2, and T5 to T7 may be set to a high level.

In an embodiment, each of the third and fourth pixel transistors T3 and T4 may be an n-channel metal-oxide-semiconductor (NMOS) transistor. In such an embodiment, a gate-on voltage of each of the third and fourth pixel transistors T3 and T4 may be set to a high level, and a gate-off voltage of each of the third and fourth pixel transistors T3 and T4 may be set to a low level. However, embodiments are not limited thereto, and in another embodiment, each of the third and fourth pixel transistors T3 and T4 may be a PMOS transistor. Hereinafter, a case in which each of the third and fourth pixel transistors T3 and T4 is the NMOS transistor will be described.

The storage capacitor CST may be connected between the first pixel power source ELVDD and the gate electrode of the first pixel transistor T1. The storage capacitor CST may charge a voltage applied to the gate electrode of the first pixel transistor T1. Further, the storage capacitor CST may stably maintain the voltage of the gate electrode of the first pixel transistor T1.

The light emitting element EL may be connected between the first pixel transistor T1 and a second pixel power source ELVSS. The light emitting element EL may emit light based on a driving current supplied from the first pixel transistor T1.

When the compensation gate signal GC changes from a low level to a high level, the third pixel transistor T3 may be turned on, and accordingly, the data voltage DATA is supplied to the gate electrode of the first pixel transistor T1. When the compensation gate signal GC changes from the high level to the low level, a kickback voltage may be generated at the gate electrode the first pixel transistor T1 due to a parasitic capacitance between a line transmitting the compensation gate signal GC and the gate electrode of the first pixel transistor T1. As such, a level of the data voltage DATA applied to the gate electrode of the first pixel transistor T1 may decrease by a level of the kickback voltage.

Figure 4:
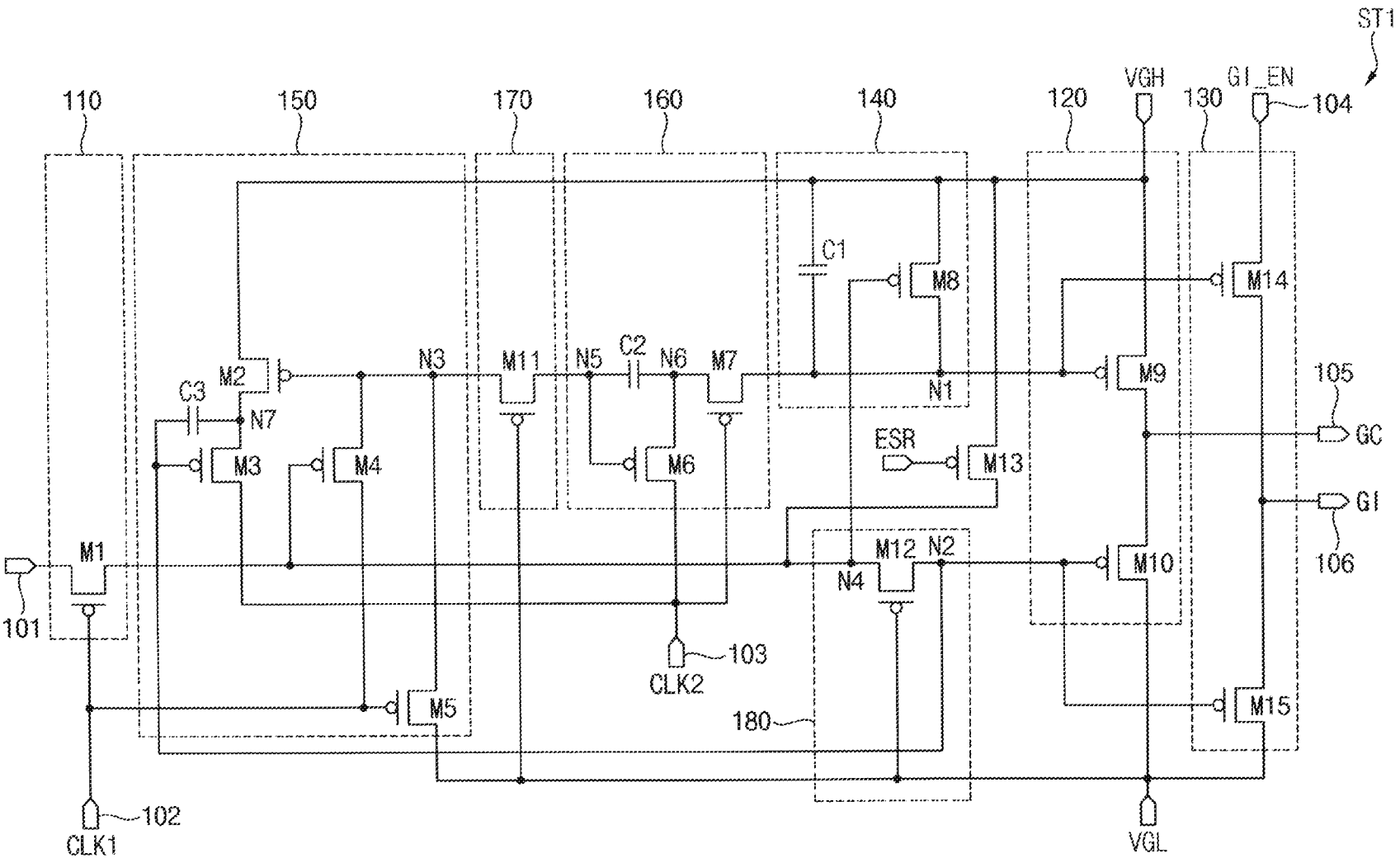
FIG. 4 is a circuit diagram illustrating a first stage of a second gate driver according to an embodiment.

FIG. 4 is a circuit diagram illustrating a first stage ST1 of a second gate driver 30 according to an embodiment. FIG. 4 illustrates only components of the first stage ST1 for convenience of description, however, components of a second stage ST2 may be substantially the same as those of the first stage ST1.

Referring to FIG. 4, the first stage ST1 may include an input circuit 110, a first output circuit 120, a second output circuit 130, a first signal processor 140, a second signal processor 150, a third signal processor 160, a first stabilizer 170, and a second stabilizer 180.

The first output circuit 120 may supply a voltage of a first power source VGH or a voltage of a second power source VGL to the first output terminal 105 in response to a voltage of a first node N1 and a voltage of a second node N2. In an embodiment, the first output circuit 120 may include a ninth transistor M9 and a tenth transistor M10.

The ninth transistor M9 may be connected between the first power source VGH and the first output terminal 105. A gate electrode of the ninth transistor M9 may be connected to the first node N1. The ninth transistor M9 may be turned on or off in response to a voltage of the first node N1. When the ninth transistor M9 is turned on, a voltage of the first power source VGH supplied to the first output terminal 105 may be used as the compensation gate signal GC of the gate-on level.

The tenth transistor M10 may be connected between the first output terminal 105 and the second power source VGL. A gate electrode of the tenth transistor M10 may be connected to the second node N2. The tenth transistor M10 may be turned on or off in response to a voltage of the second node N2. When the tenth transistor M10 is turned on, a voltage of the second power source VGL supplied to the first output terminal 105 may be used as the compensation gate signal GC of the gate-off level. In an embodiment, when the compensation gate signal GC has the gate-off level, it may be expressed that the compensation gate signal GC is not supplied.

The second output circuit 130 may supply an initialization gate enable signal GI_EN supplied to the fourth input terminal 104 or the voltage of the second power source VGL to the second output terminal 106 in response to the voltage of the first node N1 and the voltage of the second node N2. In an embodiment, the second output circuit 130 may include a fourteenth transistor M14 and a fifteenth transistor M15.

The fourteenth transistor M14 may be connected between the fourth input terminal 104 and the second output terminal 106. A gate electrode of the fourteenth transistor M14 may be connected to the first node N1. The fourteenth transistor M14 may be turned on or off in response to the voltage of the first node N1. When the fourteenth transistor M14 is turned on, the initialization gate enable signal GI_EN supplied to the second output terminal 106 may be used as the initialization gate signal GI. When the initialization gate enable signal GI_EN is the same as the voltage of the first power source VGH, the initialization gate enable signal GI_EN may be used as the initialization gate signal GI of the gate-on level. When the initialization gate enable signal GI_EN is the same as the voltage of the second power source VGL, the initialization gate enable signal GI_EN may be used as the initialization gate signal GI of the gate-off level.

The fifteenth transistor M15 may be connected between the second output terminal 106 and the second power source VGL. A gate electrode of the fifteenth transistor M15 may be connected to the second node N2. The fifteenth transistor M15 may be turned on or off in response to the voltage of the second node N2. When the fifteenth transistor M15 is turned on, the voltage of the second power source VGL supplied to the second output terminal 106 may be used as the initialization gate signal GI of the gate-off level. In an embodiment, when the initialization gate signal GI has the gate-off level, it may be expressed that the initialization gate signal GI is not supplied.

The input circuit 110 may control the voltage of the second node N2 and a voltage of the fourth node N4 in response to a signal supplied to the first input terminal 101 and the first clock signal CLK1 supplied to the second input terminal 102. In an embodiment, the input circuit 110 may include a first transistor M1.

The first transistor M1 may be connected between the first input terminal 101 and the fourth node N4. A gate electrode of the first transistor M1 may be connected to the second input terminal 102. The first transistor M1 is turned on in response to the first clock signal CLK1 being supplied to the second input terminal 102 to electrically connect the first input terminal 101 and the fourth node N4.

The first signal processor 140 may control the voltage of the first node N1 in response to the voltage of the second node N2 and the voltage of the fourth node N4. In an embodiment, the first signal processor 140 may include a first capacitor C1 and an eighth transistor M8.

The first capacitor C1 may be connected between the first power source VGH and the first node N1. The first capacitor C1 may charge a voltage applied to the first node N1. Further, the first capacitor C1 may stably maintain the voltage of the first node N1.

The eighth transistor M8 may be connected between the first power source VGH and the first node N1. A gate electrode of the eighth transistor M8 may be connected to the fourth node N4. The eighth transistor M8 may be turned on or off in response to the voltage of the fourth node N4. When the eighth transistor M8 is turned on, the voltage of the first power source VGH may be supplied to the first node N1.

The second signal processor 150 may control a voltage of a third node N3. In an embodiment, the second signal processor 150 may include a third capacitor C3, a second transistor M2, a third transistor M3, a fourth transistor M4, and a fifth transistor M5. In an embodiment, the second signal processor 150 may control the voltage of the third node N3 in response to a signal supplied to the first input terminal 101.

A first electrode of the third capacitor C3 may be connected to the second node N2. A second electrode of the third capacitor C3 may be connected to a seventh node N7 that is a common node between the second transistor M2 and the third transistor M3.

The second transistor M2 may be connected between the first power source VGH and the seventh node N7. A gate electrode of the second transistor M2 may be connected to the third node N3. The second transistor M2 may be turned on or off in response to the voltage of the third node N3.

The third transistor M3 may be connected between the seventh node N7 and the third input terminal 103. A gate electrode of the third transistor M3 may be connected to the second node N2. The third transistor M3 may be turned on or off in response to the voltage of the second node N2.

The fourth transistor M4 may be connected between the third node N3 and the second input terminal 102. A gate electrode of the fourth transistor M4 may be connected to the fourth node N4. The fourth transistor M4 may be turned on or off in response to the voltage of the fourth node N4.

The fifth transistor M5 may be connected between the third node N3 and the second power source VGL. A gate electrode of the fifth transistor M5 may be connected to the second input terminal 102. The fifth transistor M5 is turned on in response to the first clock signal CLK1 being supplied to the second input terminal 102 to supply the voltage of the second power source VGL to the third node N3.

The third signal processor 160 may control the voltage of the first node N1 in response to an output voltage of the second signal processor 150 and the second clock signal CLK2 supplied to the third input terminal 103. In an embodiment, the third signal processor 160 may include a second capacitor C2, a sixth transistor M6, and a seventh transistor M7.

A first electrode of the second capacitor C2 may be connected to a fifth node N5. A second electrode of the second capacitor C2 may be connected to a sixth node N6 that is a common node between the sixth transistor M6 and the seventh transistor M7.

The sixth transistor M6 may be connected between the sixth node N6 and the third input terminal 103. A gate electrode of the sixth transistor M6 may be connected to the fifth node N5. The sixth transistor M6 may be turned on according to a voltage of the fifth node N5 to supply a voltage corresponding to the second clock signal CLK2 supplied to the third input terminal 103 to the sixth node N6.

The seventh transistor M7 may be connected between the first node N1 and the sixth node N6. A gate electrode of the seventh transistor M7 may be connected to the third input terminal 103. The seventh transistor M7 may be turned on according to the second clock signal CLK2 supplied to the third input terminal 103 to supply the voltage of the first node N1 to the sixth node N6.

The first stabilizer 170 may be connected between the second signal processor 150 and the third signal processor 160. The first stabilizer 170 may limit a voltage drop of the third node N3. In an embodiment, the first stabilizer 170 may include an eleventh transistor M11.

The eleventh transistor M11 may be connected between the third node N3 and the fifth node N5. A gate electrode of the eleventh transistor M11 may be connected to the second power source VGL. Since the second power source VGL has a gate-off level voltage, the eleventh transistor M11 may always be maintained in a turned-on state. Accordingly, the third node N3 and the fifth node N5 may have the same voltage, and may operate as substantially the same node.

The second stabilizer 180 may be connected between the second node N2 and the fourth node N4. The second stabilizer 180 may limit the voltage drop of the second node N2. In an embodiment, the second stabilizer 180 may include a twelfth transistor M12.

The twelfth transistor M12 may be connected between the second node N2 and the fourth node N4. A gate electrode of the twelfth transistor M12 may be connected to the second power source VGL. Since the second power source VGL has a gate-off level voltage, the twelfth transistor M12 may always be maintained in a turned-on state. Accordingly, the second node N2 and the fourth node N4 may have the same voltage, and may operate as substantially the same node.

In an embodiment, the first stage ST1 may further include a thirteenth transistor M13. The thirteenth transistor M13 may be connected between the first power source VGH and the fourth node N4. A gate electrode of the thirteenth transistor M13 may receive an emission blocking signal ESR.

In an embodiment, each of the first to fifteenth transistors M1 to M15 may be a PMOS transistor. In such an embodiment, a gate-on voltage of each of the first to fifteenth transistors M1 to M15 may be set to a low level, and a gate-off voltage of each of the first to fifteenth transistors M1 to M15 may be set to a high level.

Figure 5:
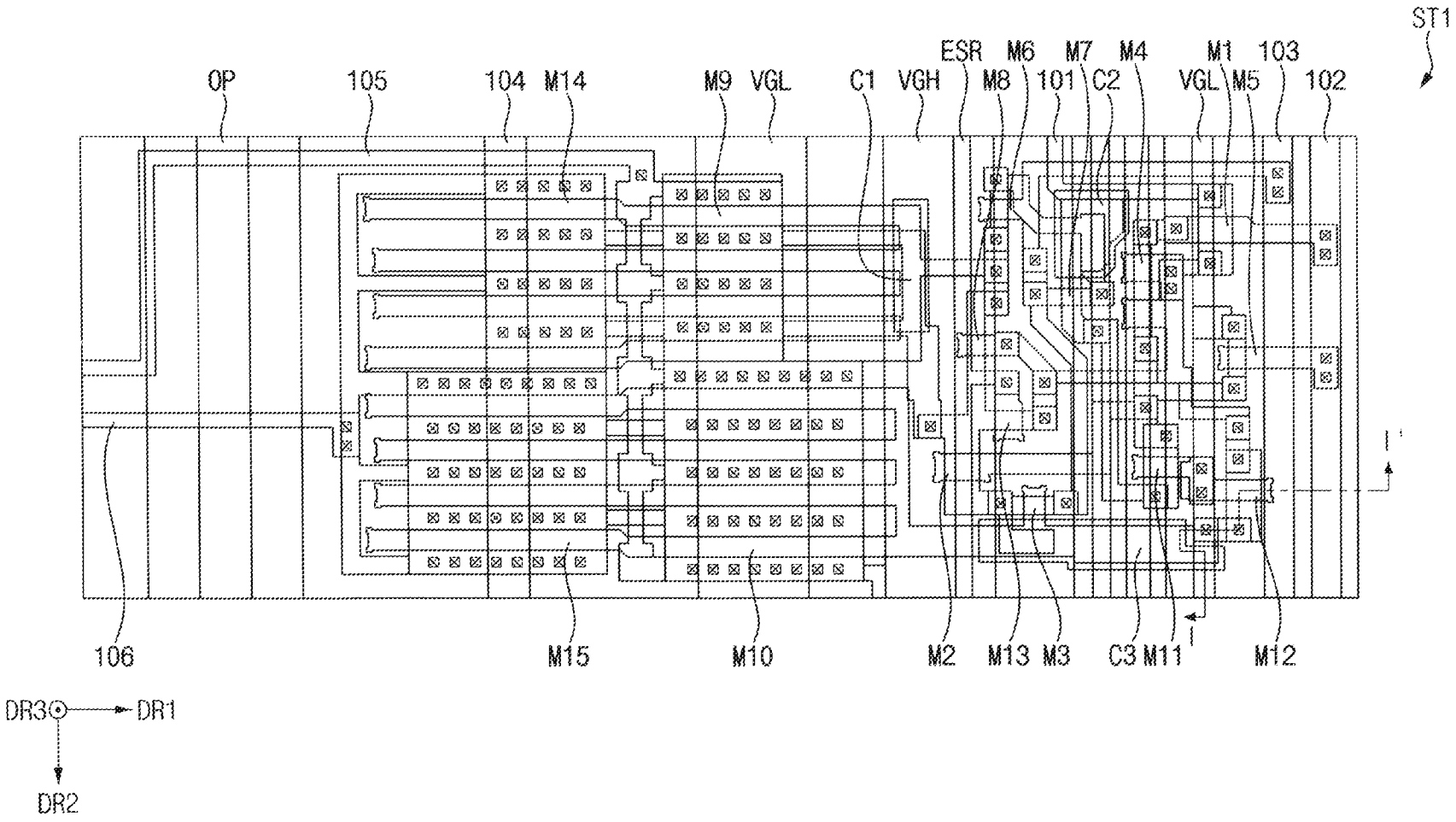
FIG. 5 is a layout view illustrating the first stage in FIG. 4 according to an embodiment.
Figure 6:
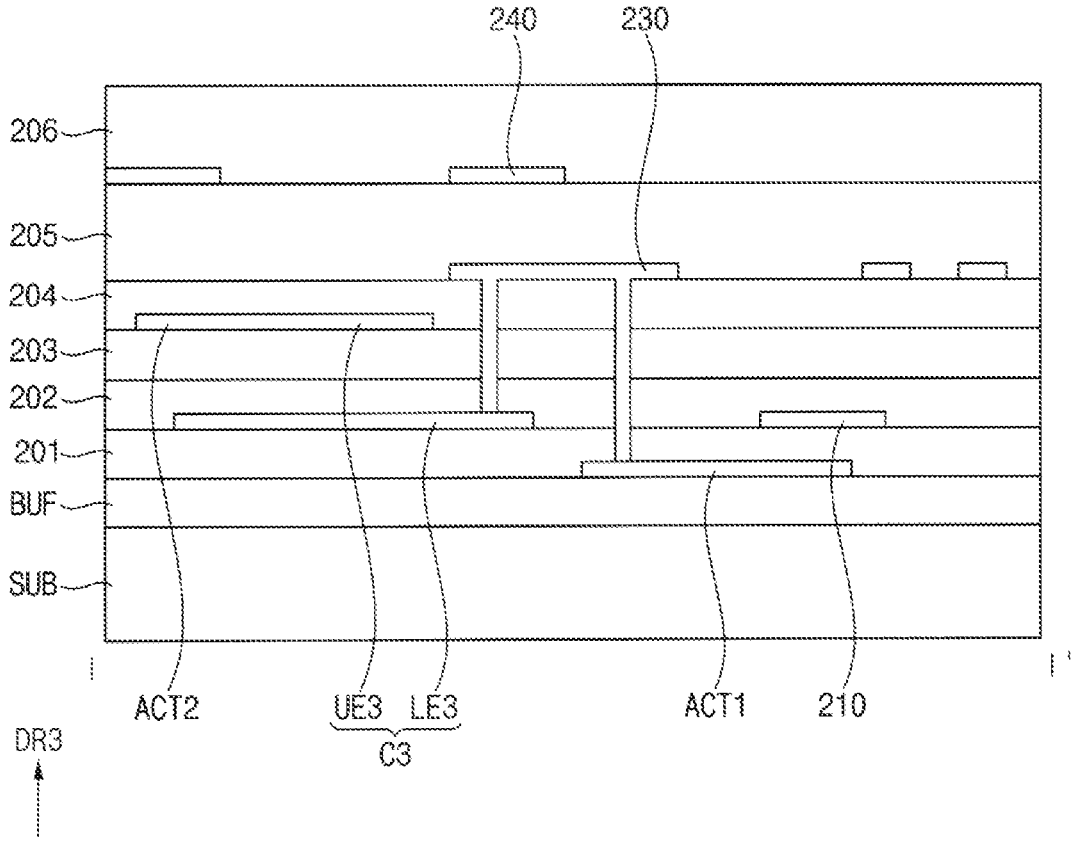
FIG. 6 is a cross-sectional view taken along sectional line I-I' in FIG. 5 according to an embodiment.

FIG. 5 is a layout view illustrating the first stage ST1 in FIG. 4 according to an embodiment. FIG. 5 illustrates only a structure of the first stage ST1 for convenience of description, however, a structure of the second stage ST2 may be substantially the same as that of the first stage ST1. FIG. 6 is a cross-sectional view taken along sectional line I-I' in FIG. 5 according to an embodiment.

Figure 10:
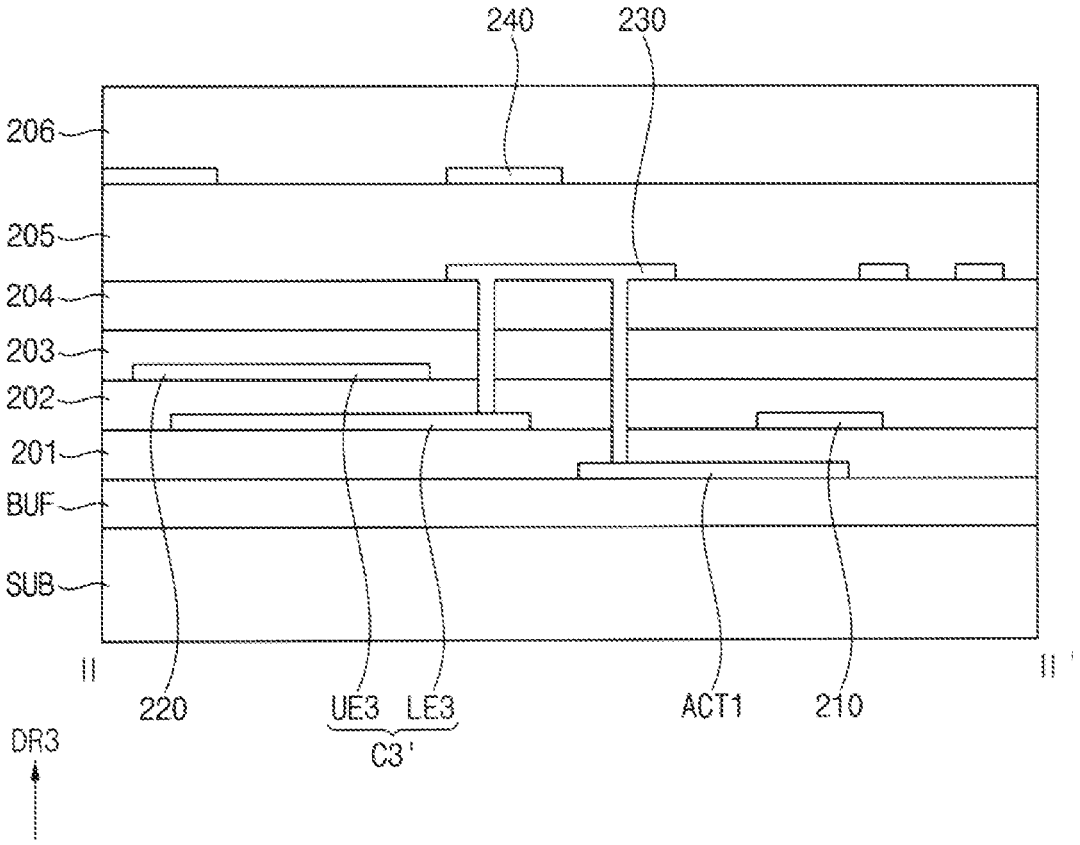
FIG. 10 is a cross-sectional view taken along sectional line II-IF in FIG. 9 according to an embodiment.

Referring to FIGS. 5 and 6, the first stage ST1 may include a substrate SUB, a buffer layer BUF, a first active layer ACT1, a first insulation layer 201, a first conductive layer 210, a second insulation layer 202, a second conductive layer 220 in FIG. 10, a third insulation layer 203, a second active layer ACT2, a fourth insulation layer 204, a third conductive layer 230, a first planarization layer 205, a fourth conductive layer 240, and a second planarization layer 206.

The substrate SUB may be a rigid substrate or a flexible substrate. The rigid substrate may include a glass substrate, a quartz substrate, a glass ceramic substrate, a crystalline glass substrate, and/or the like. The flexible substrate may include a film substrate including a polymer organic material, a plastic substrate, and/or the like. For example, the flexible substrate may include at least one of polyethersulfone (PES), polyacrylate, polyetherimide (PEI), polyethylene naphthalate (PEN), polyethylene terephthalate (PET), polyphenylene sulfide (PPS), polyarylate (PAR), polyimide (PI), polycarbonate (PC), triacetate cellulose (TAC), and cellulose acetate propionate (CAP). Further, the flexible substrate may include fiber glass reinforced plastic (FRP).

The buffer layer BUF may be disposed on the substrate SUB. The buffer layer BUF may prevent impurities from diffusing from the substrate SUB to the first active layer ACT1. The buffer layer BUF may be an inorganic insulation layer. For example, the buffer layer BUF may be formed of at least one of silicon nitride, silicon oxide, silicon oxynitride, and the like. The buffer layer BUF may be omitted depending on materials and process conditions of the substrate SUB.

The first active layer ACT1 may be disposed on the buffer layer BUF. The first active layer ACT1 may be formed of a silicon semiconductor, such as polycrystalline silicon, amorphous silicon, or the like. The first active layer ACT1 may include a source electrode, a drain electrode, and a channel of each of the first to fifteenth transistors M1 to M15. A portion of the first active layer ACT1 doped with impurities may be the source electrode and the drain electrode of each of the first to fifteenth transistors M1 to M15. A portion of the first active layer ACT1 that is not doped with the impurities may be the channel of each of the first to fifteenth transistors M1 to M15. The impurities may be P-type impurities.

The first insulation layer 201 may be disposed on the first active layer ACT1. The first insulation layer 201 may cover the first active layer ACT1 on the buffer layer BUF. The first insulation layer 201 may be an inorganic insulation layer. For example, the first insulation layer 201 may be formed of at least one of silicon nitride, silicon oxide, silicon oxynitride, and the like.

The first conductive layer 210 may be disposed on the first insulation layer 201. The first conductive layer 210 may be formed of a conductive material, such as molybdenum (Mo), titanium (Ti), aluminum (Al), silver (Ag), gold (Au), copper (Cu), and/or the like. In an embodiment, the first conductive layer 210 may have a single-layer structure including molybdenum (Mo). The first conductive layer 210 may include a gate electrode of each of the first to fifteenth transistors M1 to M15 and a first electrode of each of the first to third capacitors C1 to C3.

The second insulation layer 202 may be disposed on the first conductive layer 210. The second insulation layer 202 may cover the first conductive layer 210 on the first insulation layer 201. The second insulation layer 202 may be an inorganic insulation layer. For example, the second insulation layer 202 may be formed of at least one of silicon nitride, silicon oxide, silicon oxynitride, and the like.

The second conductive layer 220 may be disposed on the second insulation layer 202. The second conductive layer 220 may be formed of a conductive material, such as molybdenum (Mo), titanium (Ti), aluminum (Al), silver (Ag), gold (Au), copper (Cu), and/or the like. In an embodiment, the second conductive layer 220 may have a single-layer structure including molybdenum (Mo). The second conductive layer 220 may include the first output terminal 105 and the second output terminal 106.

The third insulation layer 203 may be disposed on the second conductive layer 220. The third insulation layer 203 may cover the second conductive layer 220 on the second insulation layer 202. The third insulation layer 203 may be an inorganic insulation layer. For example, the third insulation layer 203 may be formed of at least one of silicon nitride, silicon oxide, silicon oxynitride, and the like.

The second active layer ACT2 may be disposed on the third insulation layer 203. The second active layer ACT2 may be formed of an oxide semiconductor. The second active layer ACT2 may include a second electrode of each of the first to third capacitors C1 to C3. The second active layer ACT2 may be doped with N-type impurities.

The fourth insulation layer 204 may be disposed on the second active layer ACT2. The fourth insulation layer 204 may cover the second active layer ACT2 on the third insulation layer 203. The fourth insulation layer 204 may be an inorganic insulation layer. For example, the fourth insulation layer 204 may be formed of at least one of silicon nitride, silicon oxide, silicon oxynitride, and the like.

The third conductive layer 230 may be disposed on the fourth insulation layer 204. The third conductive layer 230 may be formed of a conductive material, such as molybdenum (Mo), titanium (Ti), aluminum (Al), silver (Ag), gold (Au), copper (Cu), and/or the like. In an embodiment, the third conductive layer 230 may have a multilayer structure including a titanium (Ti) layer, an aluminum (Al) layer, and a titanium (Ti) layer that are stacked. The third conductive layer 230 may include the first input terminal 101, the second input terminal 102, the third input terminal 103, a line transmitting the emission blocking signal ESR, and lines connecting the first to fifteenth transistors M1 to M15 and the first to third capacitors C1 to C3.

The first planarization layer 205 may be disposed on the third conductive layer 230. The first planarization layer 205 may cover the third conductive layer 230 on the fourth insulation layer 204. The first planarization layer 205 may be an organic insulation layer. For example, the first planarization layer 205 may be formed of at least one of polystyrene, polymethyl methacrylate (PMMA), polyacrylonitrile (PAN), polyamide (PA), polyimide (PI), poly(aryl ether) (PAE), heterocyclic polymer, parylene, epoxy, benzocyclobutene (BCB), siloxane based resin, silane based resin, and the like.

The fourth conductive layer 240 may be disposed on the first planarization layer 205. The fourth conductive layer 240 may be formed of a conductive material, such as molybdenum (Mo), titanium (Ti), aluminum (Al), silver (Ag), gold (Au), copper (Cu), and/or the like. In an embodiment, the fourth conductive layer 240 may have a multilayer structure including a titanium (Ti) layer, an aluminum (Al) layer, and a titanium (Ti) layer that are stacked. The fourth conductive layer 240 may include a line transmitting the voltage of the first power source VGH, a line transmitting the voltage of the second power source VGL, and the fourth input terminal 104.

The second planarization layer 206 may be disposed on the fourth conductive layer 240. The second planarization layer 206 may cover the fourth conductive layer 240 on the first planarization layer 205. The second planarization layer 206 may be an organic insulation layer. For example, the second planarization layer 206 may include at least one of polystyrene, polymethyl methacrylate (PMMA), polyacrylonitrile (PAN), polyamide (PA), polyimide PI, poly(aryl ether) (PAE), heterocyclic polymer, parylene, epoxy, benzocyclobutene (BCB), siloxane based resin, silane based resin, and the like.

The first planarization layer 205 and the second planarization layer 206 may define an opening OP. For instance, the opening OP exposing an upper surface of the fourth insulation layer 204 may be formed in the first planarization layer 205 and the second planarization layer 206. The opening OP may extend in the second direction DR2. The opening OP may be formed in the first planarization layer 205 and the second planarization layer 206, thereby preventing impurities from flowing into the display panel 10 through the first planarization layer 205 and the second planarization layer 206.

Figure 7:
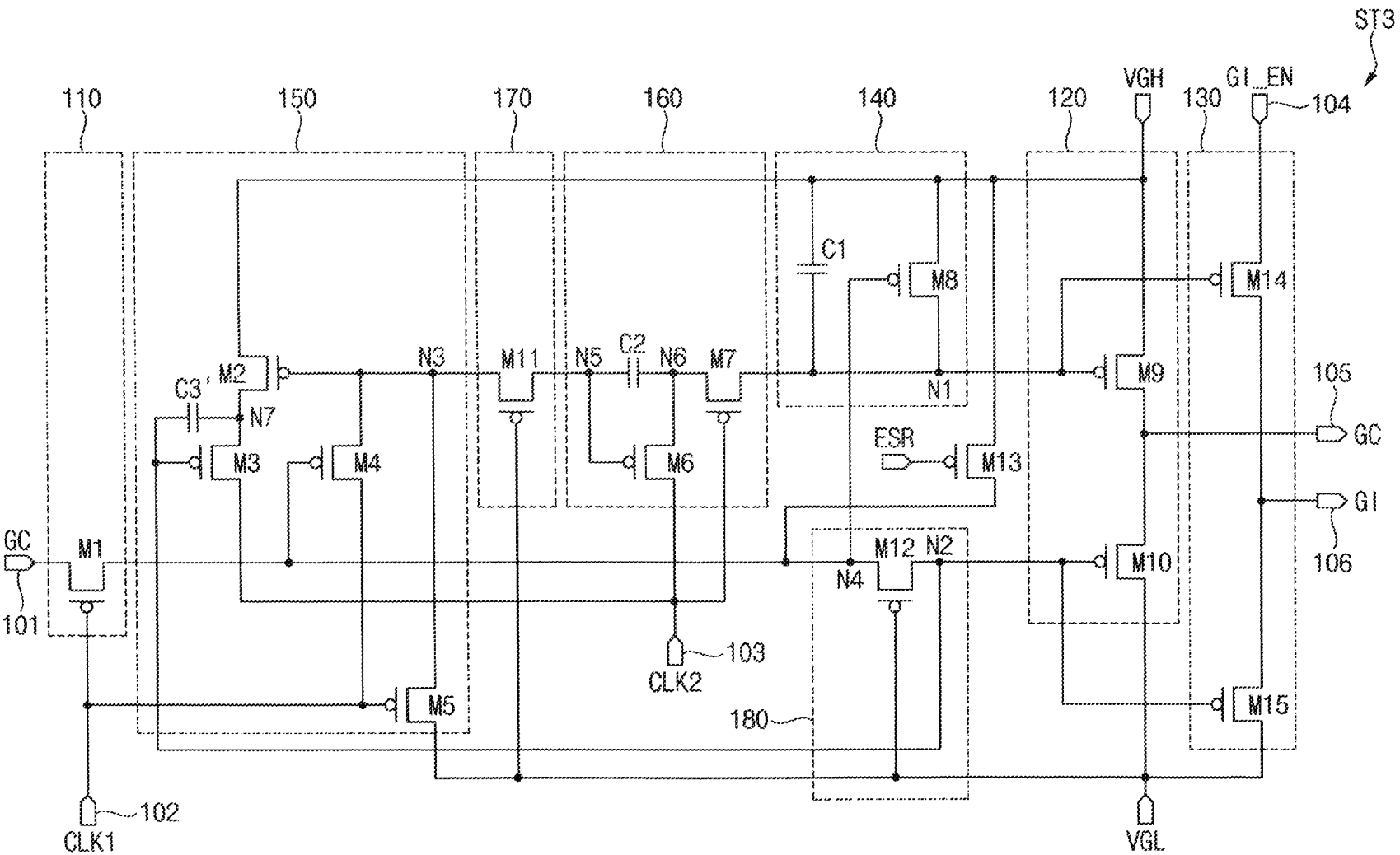
FIG. 7 is a circuit diagram illustrating a third stage of a second gate driver according to an embodiment.

FIG. 7 is a circuit diagram illustrating a third stage ST3 of a second gate driver 30 according to an embodiment.

The components of the third stage ST3 according to a first embodiment described with reference to FIG. 7 may be substantially the same as or similar those of the first stage ST1 described with reference to FIG. 4, except for a third capacitor C3'. Accordingly, a description of repeated components will be omitted.

Referring to FIG. 7, the second signal processor 150 of the third stage ST3 according to the first embodiment may include a third capacitor C3'. A capacitance of the third capacitor C3' of the third stage ST3 may be greater than a capacitance of the third capacitor C3 of each of the first stage ST1 and the second stage ST2. In an embodiment, the capacitance of the third capacitor C3' of the third stage ST3 may be greater than the sum of the capacitance of the third capacitor C3 and a parasitic capacitance between the second node N2 and the second output terminal 106 of each of the first stage ST1 and the second stage ST2.

Since the initialization gate enable signal GI_EN supplied to the fourth input terminal 104 of the third stage ST3 is the voltage of the second power source VGL, the voltage of the second power source VGL may be used as the initialization gate signal GI of the gate-off level output from the second output terminal 106 of the third stage ST3. When the capacitance of the third capacitor C3' of the third stage ST3 is relatively small, an influence of the parasitic capacitance between the second node N2 and the second output terminal 106 to the compensation gate signal GC output from the first output terminal 105 of the third stage ST3 may increase, and accordingly, the compensation gate signal GC of the gate-off level output from the first output terminal 105 of the third stage ST3 may be abnormally raised. In this case, since the kickback voltage of the gate electrode of the first pixel transistor T1 disposed in the third display area 13 that receives the compensation gate signal GC from the third stage ST3 decreases, a level of the data voltage DATA applied to the gate electrode of the first pixel transistor T1 may increase. Accordingly, the luminance of the third display area 13 may decrease, and a dark line may be recognized in the third display area 13 of the display device.

However, in the third stage ST3 according to the first embodiment, since the capacitance of the third capacitor C3' of the third stage ST3 is greater than the capacitance of the third capacitor C3 of each of the first stage ST1 and the second stage ST2, the influence of the parasitic capacitance between the second node N2 and the second output terminal 106 to the compensation gate signal GC output from the first output terminal 105 of the third stage ST3 may decrease. Accordingly, the compensation gate signal GC of the normal gate-off level may be output from the first output terminal 105 of the third stage ST3. In the first embodiment, the luminance of the third display area 13 receiving the compensation gate signal GC from the third stage ST3 may not decrease, and the dark line may not be recognized in the third display area 13 of the display device.

Figure 8:
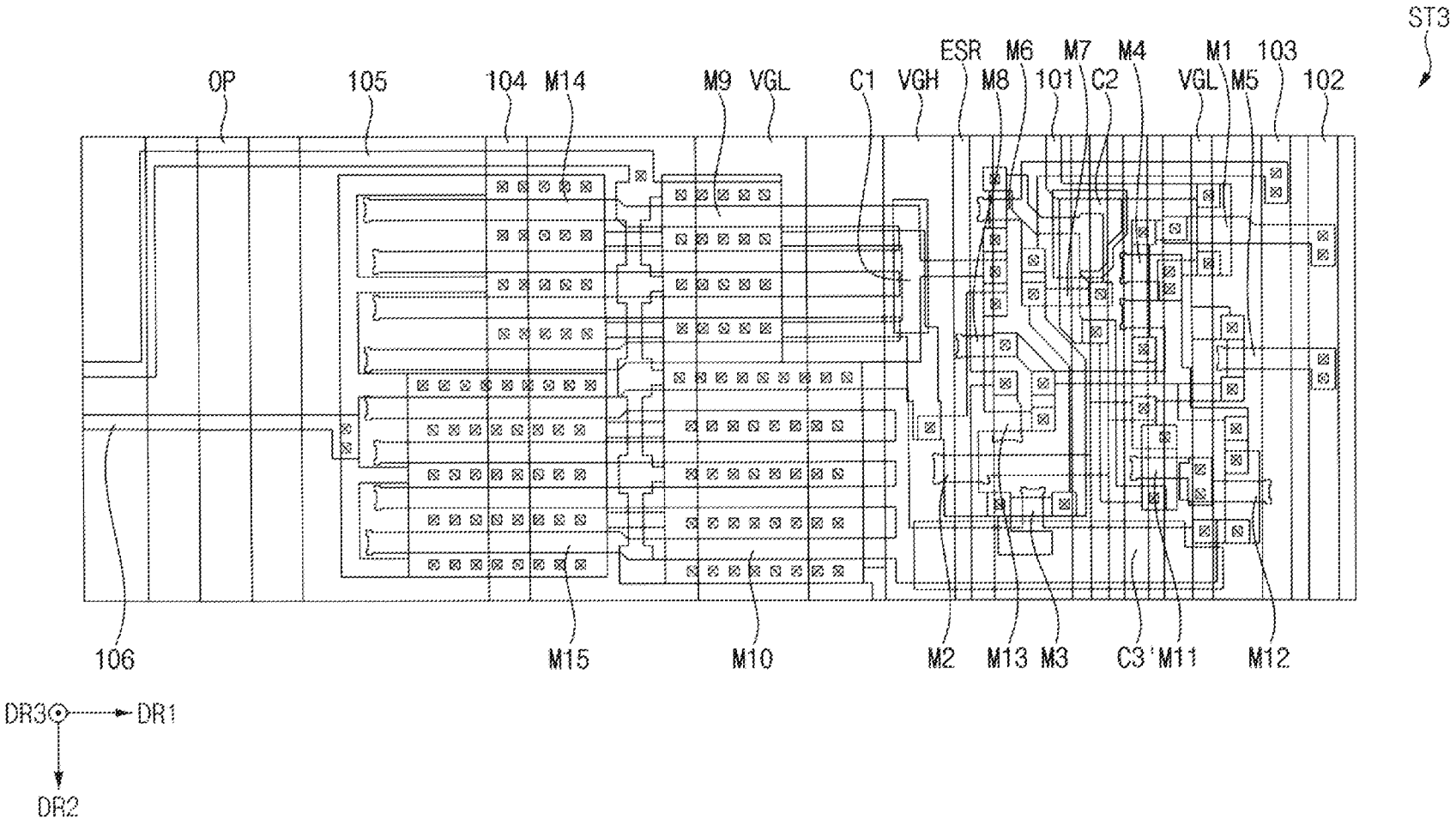
FIG. 8 is a layout view illustrating an example of the third stage in FIG. 7 according to an embodiment.

FIG. 8 is a layout view illustrating an example of the third stage ST3 in FIG. 7 according to an embodiment.

The structure of the third stage ST3 according to the first embodiment described with reference to FIG. 8 may be substantially the same as or similar to that of the first stage ST1 described with reference to FIGS. 5 and 6 except for the third capacitor C3'. Accordingly, descriptions of repeated components will be omitted.

Referring to FIGS. 5, 6, and 8, an area of the third capacitor C3' of the third stage ST3 may be greater than an area of the third capacitor C3 of each of the first stage ST1 and the second stage ST2. For instance, an area of the first electrode LE3 and an area of the second electrode UE3 of the third capacitor C3' of the third stage ST3 may be greater than an area of the first electrode LE3 and an area of the second electrode UE3 of each of the third capacitor C3 of each of the first stage ST1 and the second stage ST2, respectively. As the area of the third capacitor C3' of the third stage ST3 is greater than the area of the third capacitor C3 of each of the first stage ST1 and the second stage ST2, the capacitance of the third capacitor C3' of the third stage ST3 may be greater than the capacitance of the third capacitor C3 of each of the first stage ST1 and the second stage ST2.

The first electrode LE3 of the third capacitor C3' of the third stage ST3 may be included in the first conductive layer 210, and the second electrode UE3 of the third capacitor C3' of the third stage ST3 may be included in the second active layer ACT2. As such, the first conductive layer 210 may include the first electrode LE3 of the third capacitor C3' of the third stage ST3, and the second active layer ACT2 may include the second electrode UE3 of the third capacitor C3' of the third stage ST3.

Figure 9:
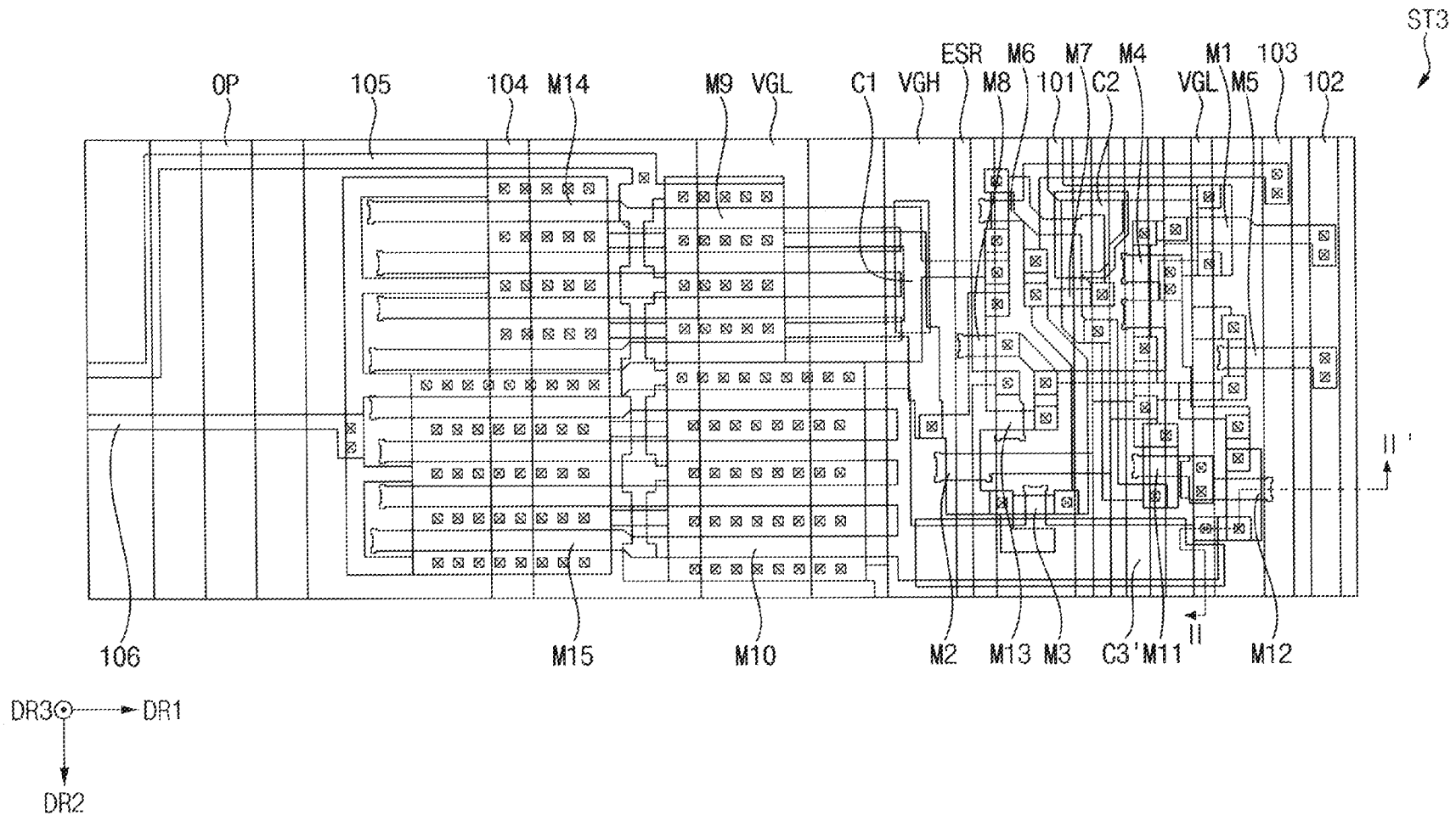
FIG. 9 is a layout view illustrating another example of the third stage in FIG. 7 according to an embodiment.

FIG. 9 is a layout view illustrating another example of the third stage ST3 in FIG. 7 according to an embodiment. FIG. 10 is a cross-sectional view taken along sectional line II-II' in FIG. 9 according to an embodiment.

The structure of the third stage ST3 described with reference to FIGS. 9 and 10 may be substantially the same as or similar to the structure of the third stage ST3 described with reference to FIG. 8, except for the third capacitor C3'. Accordingly, descriptions of the repeated components will be omitted.

Referring to FIGS. 9 and 10, the first electrode LE3 of the third capacitor C3' of the third stage ST3 may be included in the first conductive layer 210, and the second electrode UE3 of the third capacitor C3' of the third stage ST3 may be included in the second conductive layer 220. As such, the first conductive layer 210 may include the first electrode LE3 of the third capacitor C3' of the third stage ST3, and the second conductive layer 220 may include the second electrode UE3 of the third capacitor C3 of the third stage ST3.

Figure 11:
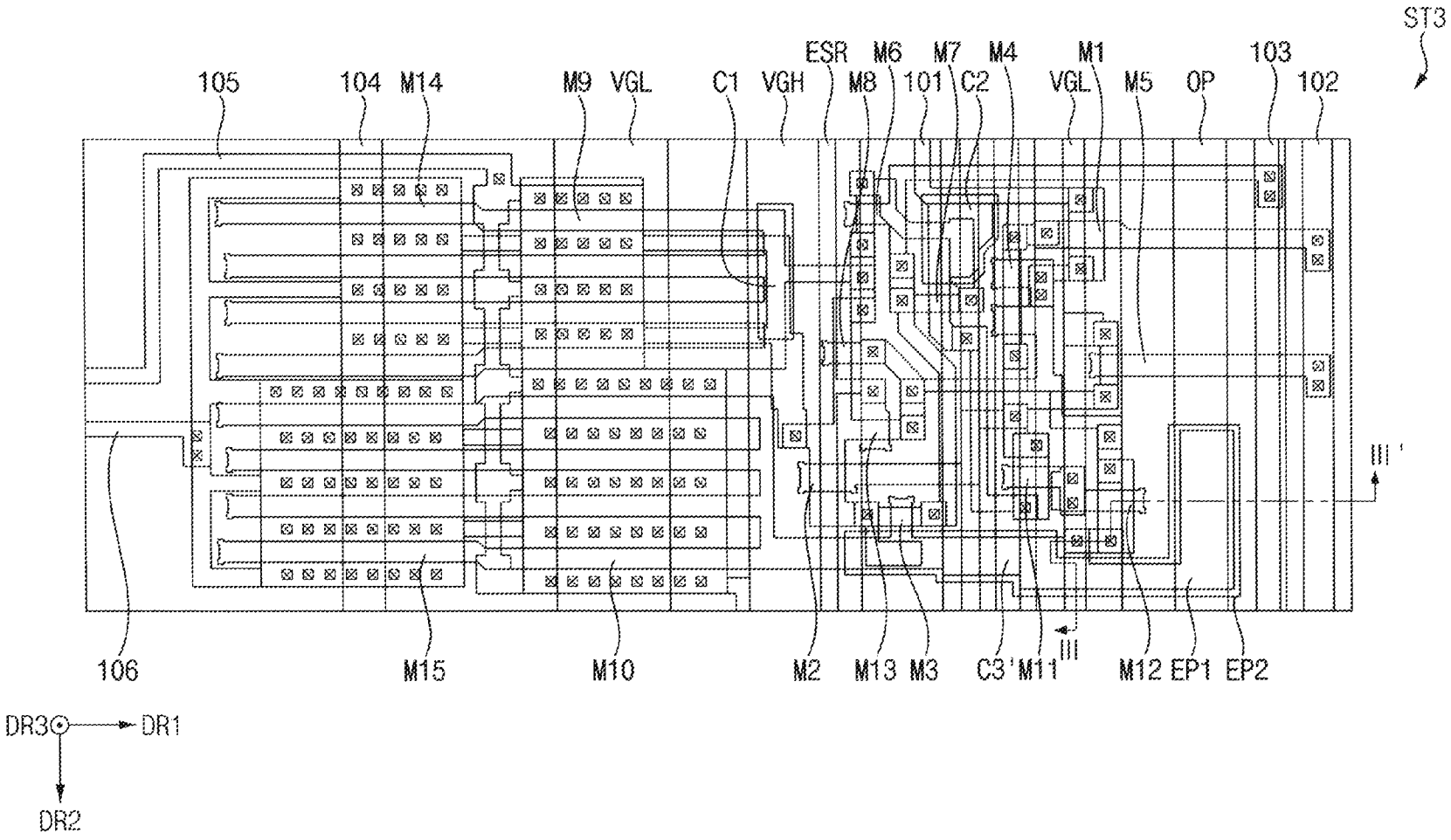
FIG. 11 is a layout view illustrating still another example of the third stage in FIG. 7 according to an embodiment.
Figure 12:
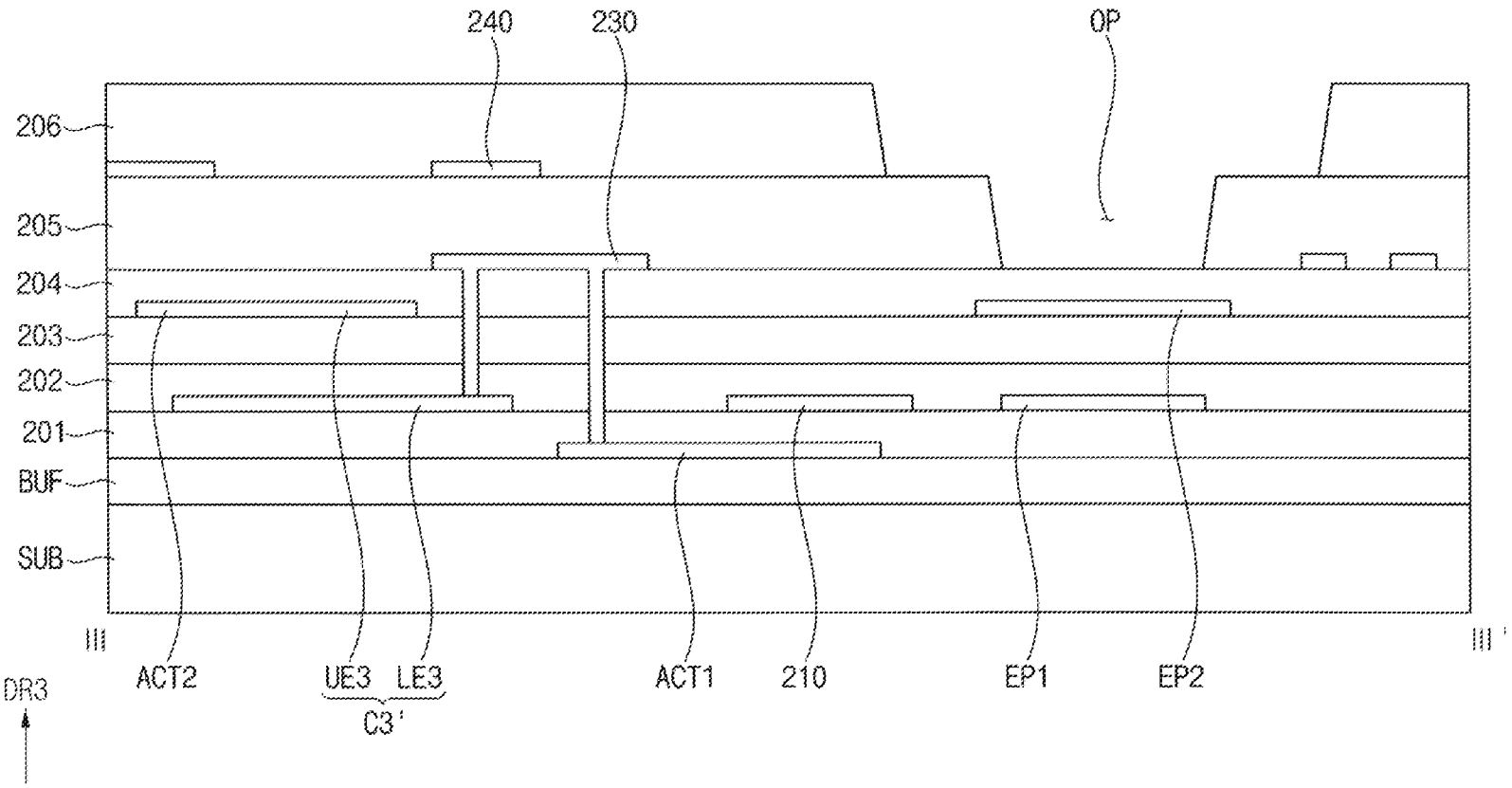
FIG. 12 is a cross-sectional view taken along sectional line in FIG. 11 according to an embodiment.

FIG. 11 is a layout view illustrating still another example of the third stage ST3 in FIG. 7 according to an embodiment. FIG. 12 is a cross-sectional view taken along sectional line III-III' in FIG. 11 according to an embodiment.

The structure of the third stage ST3 described with reference to FIGS. 11 and 12 may be substantially the same as or similar to that of the third stage ST3 described with reference to FIG. 8, except for the third capacitor C3' and the opening OP. Accordingly, descriptions of the repeated components will be omitted.

Referring to FIGS. 11 and 12, the opening OP may be positioned between the first input terminal 101 and the third input terminal 103. For example, the opening OP may be positioned in the first direction DR1 from the first input terminal 101, and the third input terminal 103 may be positioned in the first direction DR1 from the opening OP.

The first electrode LE3 of the third capacitor C3' of the third stage ST3 may include a first extending portion EP1 that overlaps the opening OP, and the second electrode UE3 of the third capacitor C3' of the third stage ST3 may include a second extending portion EP2 that overlaps the opening OP. As the first electrode LE3 and the second electrode UE3 of the third capacitor C3' of the third stage ST3 include the first extending portion EP1 and the second extending portion EP2, respectively, the capacitance of the third capacitor C3' of the third stage ST3 may increase. Further, as each of the first extending portion EP1 and the second extending portion EP2 overlaps the opening OP, the area of each of the first electrode LE3 and the second electrode UE2 of the third capacitor C3' of the third stage ST3 may increase without an increase of a dead space.

Figure 13:
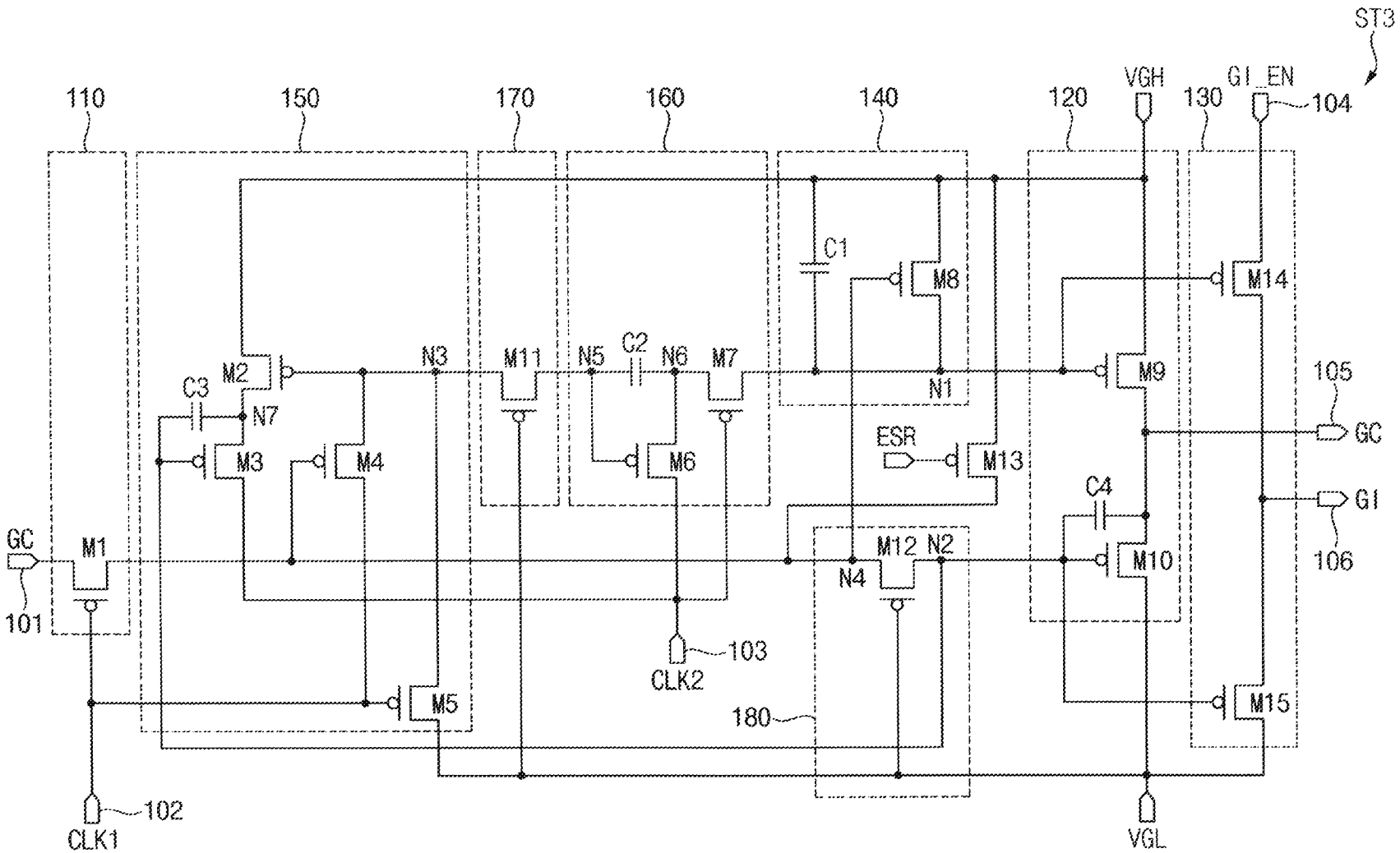
FIG. 13 is a circuit diagram illustrating a third stage of a second gate driver according to an embodiment.

FIG. 13 is a circuit diagram illustrating a third stage ST3 of a second gate driver 30 according to an embodiment.

The structure of the third stage ST3 according to a second embodiment described with reference to FIG. 13 may be substantially the same as or similar to that of the first stage ST1 described with reference to FIG. 4, except for the addition of a fourth capacitor C4. As such, descriptions of repeated components will be omitted.

Referring to FIG. 13, the first output circuit 120 of the third stage ST3 according to the second embodiment may further include a fourth capacitor C4. A first electrode of the fourth capacitor C4 may be connected to the second node N2. A second electrode of the fourth capacitor C4 may be connected to the first output terminal 105. In an embodiment, a capacitance of the fourth capacitor C4 may be greater than the parasitic capacitance between the second node N2 and the second output terminal 106.

In an embodiment, the first output circuit 120 of each of the first stage ST1 and the second stage ST2 may not include (or may exclude) the fourth capacitor C4. As such, the first output circuit 120 of each of the first stage ST1 and the second stage ST2 may include only the ninth transistor M9 and the tenth transistor M10. However, embodiments are not limited thereto, and in another embodiment, the first output circuit 120 of each of the first stage ST1 and the second stage ST2 may further include the fourth capacitor C4.

Since the initialization gate enable signal GI_EN supplied to the fourth input terminal 104 of the third stage ST3 is the voltage of the second power source VGL, the voltage of the second power source VGL may be used as the initialization gate signal GI of the gate-off level output from the second output terminal 106 of the third stage ST3. When the third stage ST3 does not include the fourth capacitor C4, the influence of the parasitic capacitance between the second node N2 and the second output terminal 106 to the compensation gate signal GC output from the first output terminal 105 of the third stage ST3 may increase, and accordingly, the compensation gate signal GC of the gate-off level output from the first output terminal 105 of the third stage ST3 may be abnormally raised. In this case, the luminance of the third display area 13 receiving the compensation gate signal GC from the third stage ST3 may decrease, and a dark line may be recognized in the third display area 13 of the display device.

However, in the third stage ST3 according to the second embodiment, since the third stage ST3 includes the fourth capacitor C4, the influence of the parasitic capacitance between the second node N2 and the second output terminal 106 to the compensation gate signal GC output from the first output terminal 105 of the third stage ST3 may decrease. Accordingly, the compensation gate signal GC of the normal gate-off level may be output from the first output terminal 105 of the third stage ST3. In the second embodiment, the luminance of the third display area 13 receiving the compensation gate signal GC from the third stage ST3 may not decrease, and the dark line may not be recognized in the third display area 13 of the display device.

Figure 14:
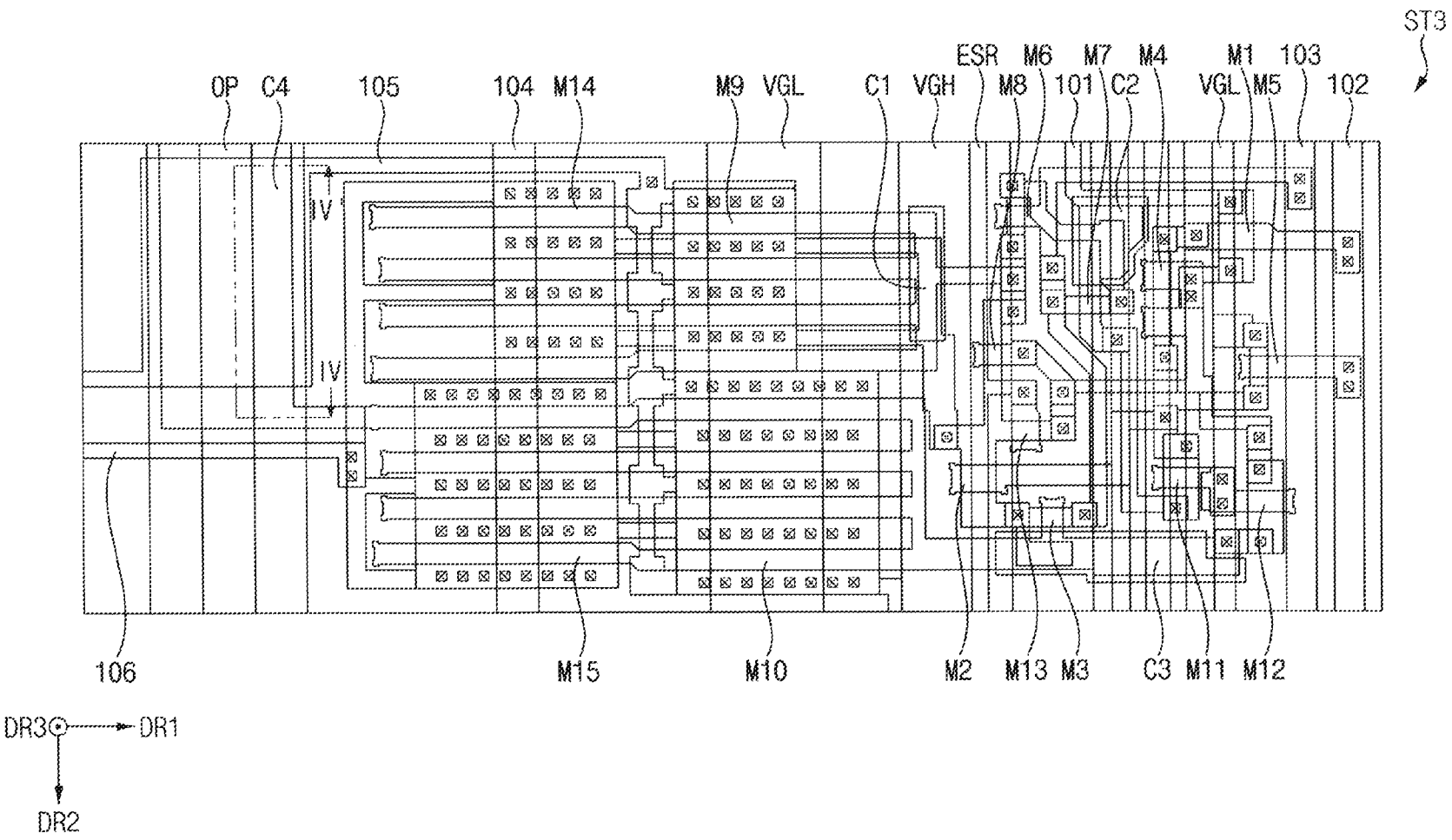
FIG. 14 is a layout view illustrating an example of the third stage in FIG. 13 according to an embodiment.
Figure 15:
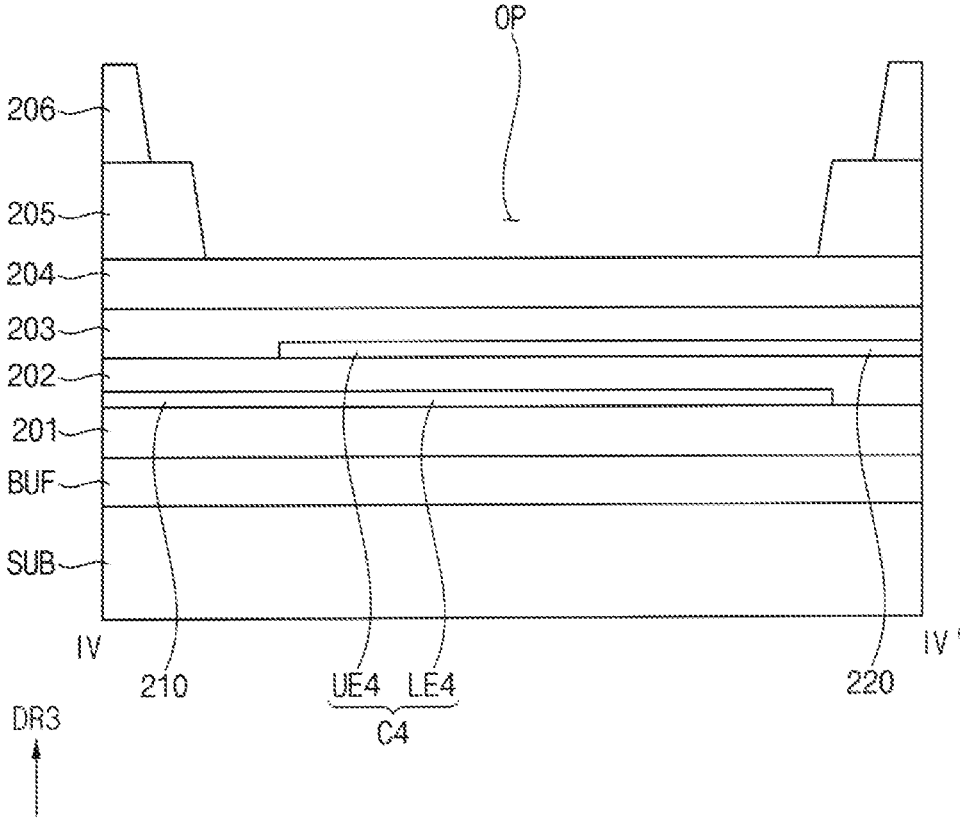
FIG. 15 is a cross-sectional view taken along sectional line IV-IV' in FIG. 14 according to an embodiment.

FIG. 14 is a layout view illustrating an example of the third stage ST3 in FIG. 13 according to an embodiment. FIG. 15 is a cross-sectional view taken along sectional line IV-IV' in FIG. 14 according to an embodiment.

The structure of the third stage ST3 according to the second embodiment described with reference to FIGS. 14 and 15 may be substantially the same as or similar to the structure of the first stage ST1 described with reference to FIGS. 5 and 6 except for the addition of the fourth capacitor C4. Accordingly, descriptions of the repeated components will be omitted.

Referring to FIGS. 14 and 15, the fourth capacitor C4 may overlap the opening OP. As such, a first electrode LE4 and a second electrode UE4 of the fourth capacitor C4 may overlap the opening OP. As the fourth capacitor C4 overlaps the opening OP, the third stage ST3 may include the fourth capacitor C4 without an increase of a dead space.

The first electrode LE4 of the fourth capacitor C4 may be included in the first conductive layer 210, and the second electrode UE4 of the fourth capacitor C4 may be included in the second conductive layer 220. In this manner, the first conductive layer 210 may include the first electrode LE4 of the fourth capacitor C4, and the second conductive layer 220 may include the second electrode UE3 of the fourth capacitor C4. For example, the second electrode UE4 of the fourth capacitor C4 may be a portion of the first output terminal 105.

Figure 16:
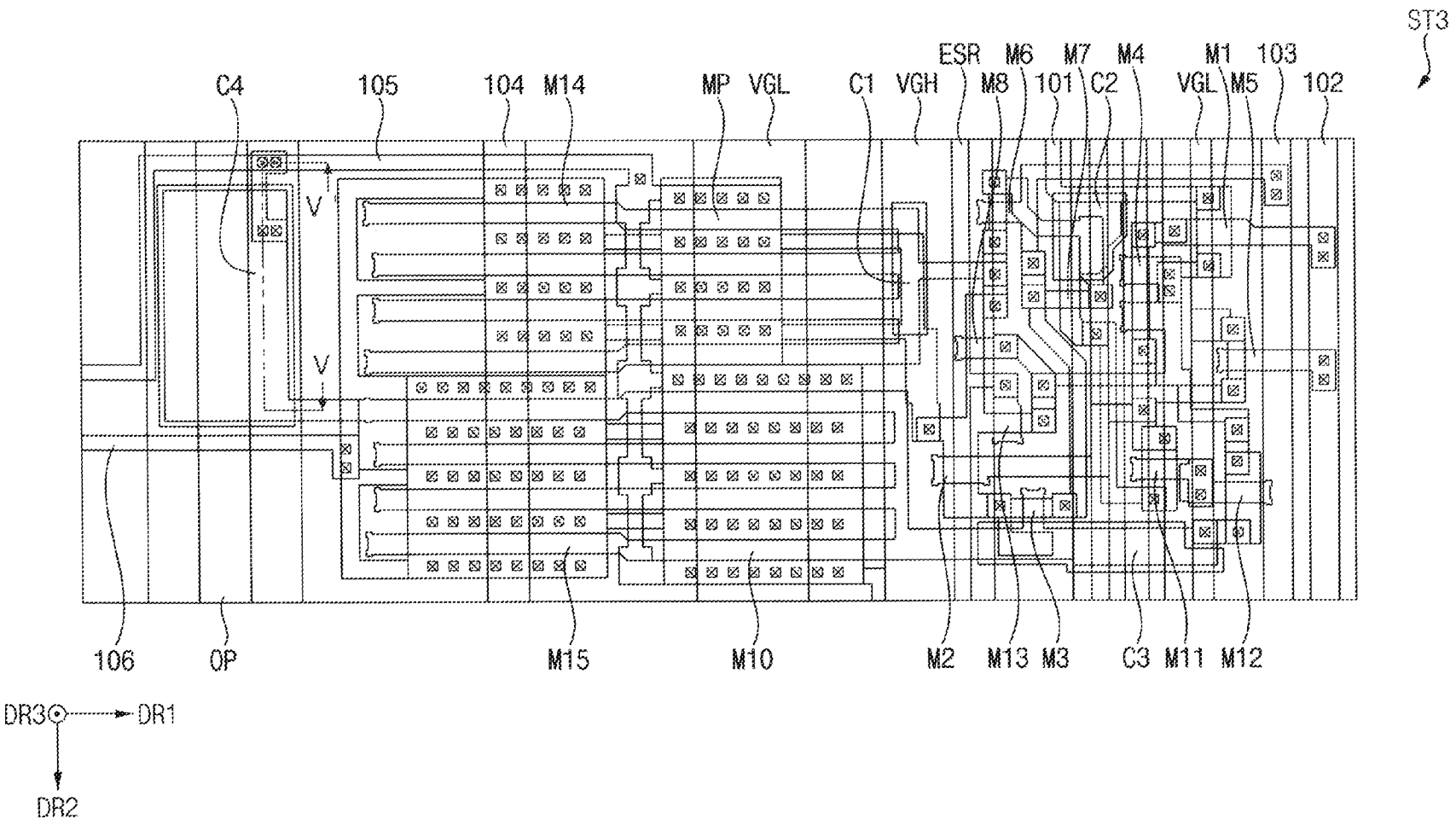
FIG. 16 is a layout view illustrating another example of the third stage in FIG. 13 according to an embodiment.
Figure 17:
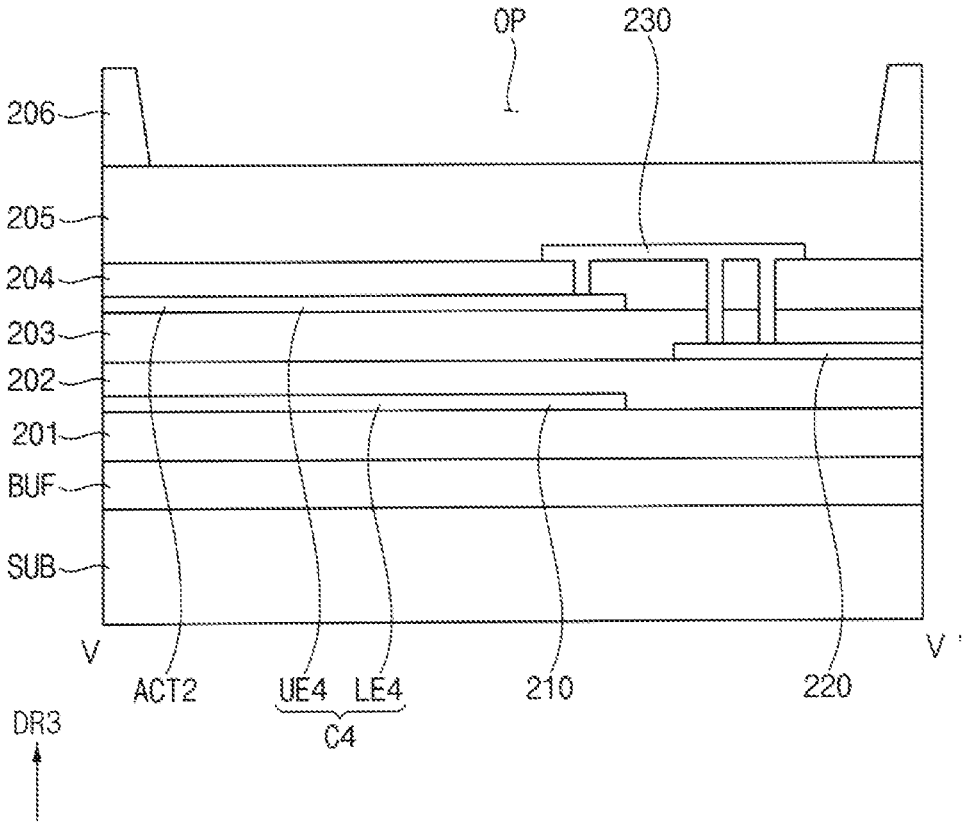
FIG. 17 is a cross-sectional view taken along sectional line V-V' in FIG. 16 according to an embodiment.

FIG. 16 is a layout view illustrating another example of the third stage ST3 in FIG. 13 according to an embodiment. FIG. 17 is a cross-sectional view taken along sectional line V-V' in FIG. 16 according to an embodiment.

The structure of the third stage ST3 described with reference to FIGS. 16 and 17 may be substantially the same as or similar to the structure of the third stage ST3 described with reference to FIGS. 14 and 15, except for the fourth capacitor C4. Accordingly, descriptions of repeated components will be omitted.

Referring to FIGS. 16 and 17, the first electrode LE4 of the fourth capacitor C4 may be included in the first conductive layer 210, and the second electrode UE4 of the fourth capacitor C4 may be included in the second active layer ACT2. In this manner, the first conductive layer 210 may include the first electrode LE4 of the fourth capacitor C4, and the second active layer ACT2 may include the second electrode UE3 of the fourth capacitor C4. For example, the second electrode UE4 of the fourth capacitor C4 may be connected to the first output terminal 105 through a connection line included in the third conductive layer 230.

Figure 18:
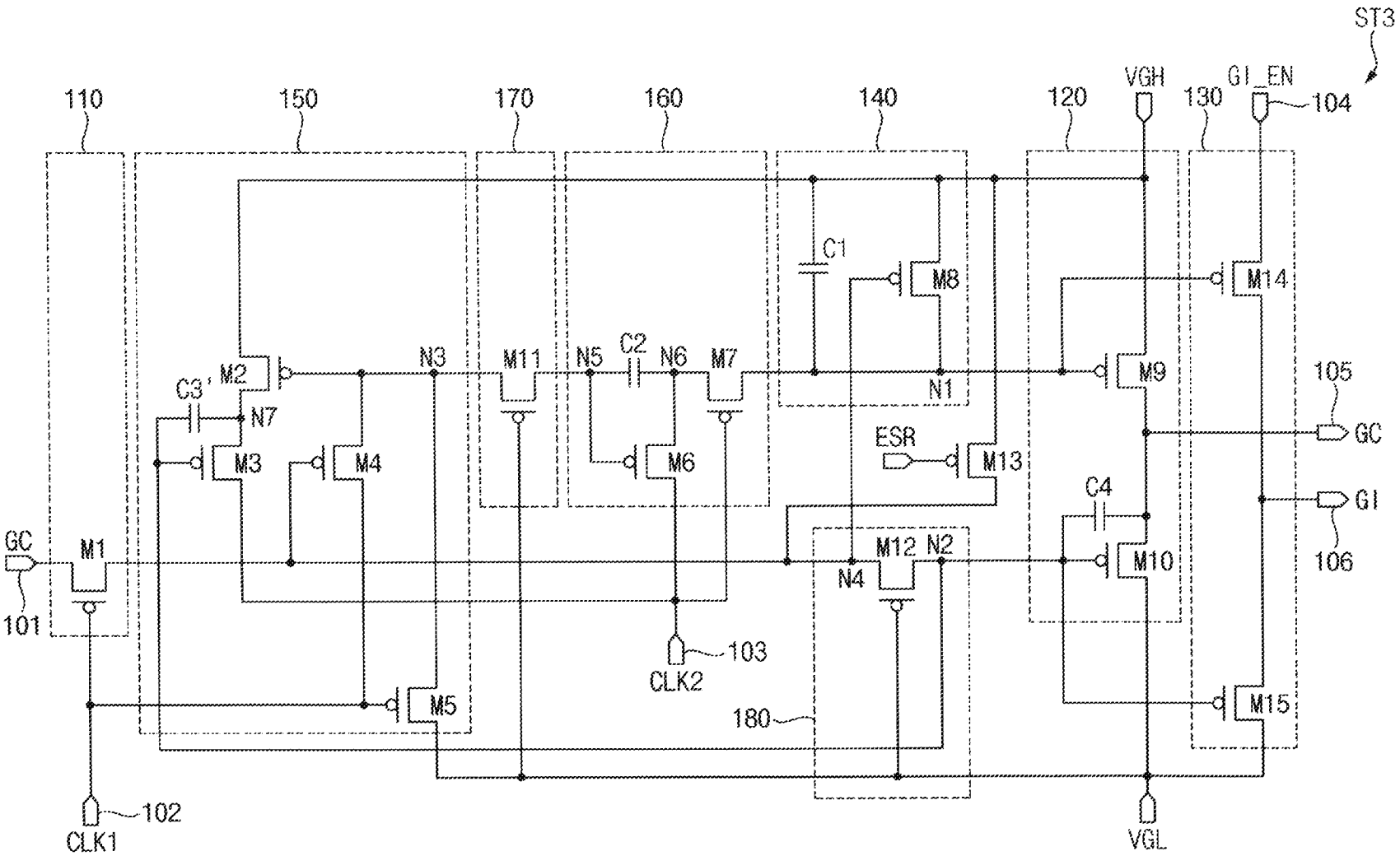
FIG. 18 is a circuit diagram illustrating a third stage of a second gate driver according to an embodiment.

FIG. 18 is a circuit diagram illustrating a third stage ST3 of a second gate driver 30 according to an embodiment.

The components of the third stage ST3 according to a third embodiment described with reference to FIG. 18 may be substantially the same as or similar to those of the third stage ST3 according to the first embodiment described with reference to FIG. 7, except for the addition of the fourth capacitor C4. Accordingly, descriptions of the repeated components will be omitted.

Referring to FIG. 18, the second signal processor 150 of the third stage ST3 according to the third embodiment may include a third capacitor C3', and the first output circuit 120 of the third stage ST3 according to the third embodiment may further include a fourth capacitor C4. A first electrode of the fourth capacitor C4 may be connected to the second node N2. A second electrode of the fourth capacitor C4 may be connected to the first output terminal 105. In an embodiment, a capacitance of the fourth capacitor C4 may be greater than the parasitic capacitance between the second node N2 and the second output terminal 106.

In the third stage ST3 according to the third embodiment, since the capacitance of the third capacitor C3' of the third stage ST3 is greater than the capacitance of the third capacitor C3 of each of the first stage ST1 and the second stage ST2, and the third stage ST3 includes the fourth capacitor C4, the influence of the parasitic capacitance between the second node N2 and the second output terminal 106 to the compensation gate signal GC output from the first output terminal 105 of the third stage ST3 may decrease. Accordingly, the compensation gate signal GC of the normal gate-off level may be output from the first output terminal 105 of the third stage ST3. In the third embodiment, the luminance of the third display area 13 receiving the compensation gate signal GC from the third stage ST3 may not decrease, and a dark line may not be recognized in the third display area 13 of the display device.

The display device according to various embodiments may be applied to a display device included in, for instance, a computer, a notebook, a mobile phone, a smart phone, a smart pad, a PMP, a PDA, an MP3 player, and/or the like.

Although certain embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A gate driver, comprising:

at least one stage comprising:

a first output circuit configured to supply a voltage of a first power source or a voltage of a second power source to a first output terminal in response to a voltage of a first node and a voltage of a second node, the first output circuit comprising a fourth capacitor connected between the second node and the first output terminal;

a second output circuit configured to supply a signal supplied to a fourth input terminal or the voltage of the second power source to a second output terminal in response to the voltage of the first node and the voltage of the second node;

an input circuit configured to control the voltage of the second node in response to a signal supplied to a first input terminal and a signal supplied to a second input terminal;

a first signal processor configured to control the voltage of the first node in response to the voltage of the second node;

a second signal processor configured to control a voltage of a third node in response to the signal supplied to the first input terminal;

a third signal processor connected between the first node and the third node, the third signal processor being configured to control the voltage of the first node in response to an output voltage of the second signal processor and a signal supplied to a third input terminal; and a first stabilizer connected between the second signal processor and the third signal processor, the first stabilizer being configured to limit a voltage drop of the third node.

2. The gate driver of claim 1, wherein a capacitance of the fourth capacitor is greater than a parasitic capacitance between the second node and the second output terminal.

3. The gate driver of claim 1, wherein the signal supplied to the fourth input terminal is the voltage of the second power source.

4. The gate driver of claim 1, wherein the first output circuit further comprises:

a ninth transistor connected between the first power source and the first output terminal, the ninth transistor comprising a gate electrode connected to the first node; and a tenth transistor connected between the second power source and the first output terminal, the tenth transistor comprising a gate electrode connected to the second node.

5. The gate driver of claim 1, wherein the second output circuit comprises:

a fourteenth transistor connected between the fourth input terminal and the second output terminal, the fourteenth transistor comprising a gate electrode connected to the first node; and a fifteenth transistor connected between the second power source and the second output terminal, the fifteenth transistor comprising a gate electrode connected to the second node.

6. The gate driver of claim 1, wherein the input circuit comprises:

a first transistor connected between the first input terminal and the second node, the first transistor comprising a gate electrode connected to the second input terminal.

7. The gate driver of claim 1, wherein the first signal processor comprises:

a first capacitor connected between the first power source and the first node; and an eighth transistor connected between the first power source and the first node, the eighth transistor comprising a gate electrode connected to the second node.

8. The gate driver of claim 1, wherein the second signal processor comprises:

a third capacitor connected between the first power source and the second node;

a third transistor connected between the first power source and the third input terminal, the third transistor comprising a gate electrode connected to the second node;

a second transistor connected between the first power source and a common node of the third capacitor and the third transistor, the second transistor comprising a gate electrode connected to the third node;

a fourth transistor connected between the third node and the second input terminal, the fourth transistor comprising a gate electrode connected to the second node; and a fifth transistor connected between the third node and the second power source, the fifth transistor comprising a gate electrode connected to the second input terminal.

9. The gate driver of claim 1, wherein the third signal processor comprises:

a second capacitor connected between the third node and a sixth node;

a sixth transistor connected between the sixth node and the third input terminal, the sixth transistor comprising a gate electrode connected to the third node; and a seventh transistor connected between the first node and the sixth node, the seventh transistor comprising a gate electrode connected to the third input terminal.

10. The gate driver of claim 1, wherein the at least one stage further comprises:

a second stabilizer connected between a fourth node connected to the first input terminal and the second node, the second stabilizer being configured to limit a voltage drop of the second node.

11. The gate driver of claim 1, wherein the at least one stage further comprises:

a first active layer comprising a source electrode and a drain electrode of at least one transistor;

a first conductive layer disposed on the first active layer, the first conductive layer comprising a gate electrode of the at least one transistor, a first electrode of at least one capacitor, and a first electrode of the fourth capacitor;

a second conductive layer disposed on the first conductive layer, the second conductive layer comprising the first output terminal and the second output terminal; and a second active layer disposed on the second conductive layer, the second active layer comprising a second electrode of the at least one capacitor.

12. The gate driver of claim 11, wherein the second active layer further comprises a second electrode of the fourth capacitor.

13. The gate driver of claim 11, wherein the second conductive layer further comprises a second electrode of the fourth capacitor.

14. The gate driver of claim 11, wherein the at least one stage further comprises:

a third conductive layer disposed on the second active layer, the third conductive layer comprising the first input terminal, the second input terminal, and the third input terminal;

a planarization layer disposed on the third conductive layer, the planarization layer comprising an opening overlapping the fourth capacitor; and a fourth conductive layer disposed on the planarization layer, the fourth conductive layer comprising:

a first line configured to transmit the voltage of the first power source;

a second line configured to transmit the voltage of the second power source; and the fourth input terminal.

15. A display device, comprising:

a display panel comprising a first display area configured to be driven at a first frequency, a second display area configured to be driven at a second frequency different from the first frequency, and a third display area positioned between the first display area and the second display area; and a gate driver comprising at least one first stage configured to provide a first gate signal to the first display area, at least one second stage configured to provide the first gate signal to the second display area, and at least one third stage configured to provide the first gate signal to the third display area, wherein each of the at least one first stage, the at least one second stage, and the at least one third stage comprises:

a first output circuit configured to supply a voltage of a first power source or a voltage of a second power source to a first output terminal in response to a voltage of a first node and a voltage of a second node;

a second output circuit configured to supply a signal supplied to a fourth input terminal or the voltage of the second power source to a second output terminal in response to the voltage of the first node and the voltage of the second node;

an input circuit configured to control the voltage of the second node in response to a signal supplied to a first input terminal and a signal supplied to a second input terminal;

a first signal processor configured to control the voltage of the first node in response to the voltage of the second node;

a second signal processor configured to control a voltage of a third node in response to the signal supplied to the first input terminal; and a third signal processor connected between the first node and the third node, the third signal processor being configured to control the voltage of the first node in response to an output voltage of the second signal processor and a signal supplied to a third input terminal, and wherein the first output circuit of the at least one third stage comprises a fourth capacitor connected between the second node and the first output terminal.

16. The display device of claim 15, wherein the first output circuit of each of the at least one first stage and the at least one second stage excludes the fourth capacitor.

17. The display device of claim 15, wherein:

the signal supplied to the fourth input terminal of the at least one first stage is the voltage of the first power source; and the signal supplied to the fourth input terminal of each of the at least one second stage and the at least one third stage is the voltage of the second power source.

18. The display device of claim 15, wherein:

the at least one first stage is configured to provide a second gate signal to the first display area and the third display area; and each of the at least one second stage and the at least one third stage is configured to provide the second gate signal to the second display area.

19. The display device of claim 15, wherein the third display area is configured to be driven at the first frequency.

20. The display device of claim 15, wherein the first frequency is greater than the second frequency.

21. The display device of claim 15, wherein:

the second signal processor of each of the at least one first stage, the at least one second stage, and the at least one third stage comprises a third capacitor connected between the first power source and the second node; and a capacitance of the third capacitor of the at least one third stage is greater than a capacitance of the third capacitor of each of the at least one first stage and the at least one second stage.

22. A display device, comprising:

a display panel comprising a first display area configured to be driven at a first frequency, a second display area configured to be driven at a second frequency different from the first frequency, and a third display area positioned between the first display area and the second display area; and a gate driver comprising at least one first stage configured to provide a first gate signal to the first display area, at least one second stage configured to provide the first gate signal to the second display area, and at least one third stage configured to provide the first gate signal to the third display area, wherein each of the at least one first stage, the at least one second stage, and the at least one third stage comprises:

a first output circuit configured to supply a voltage of a first power source or a voltage of a second power source to a first output terminal in response to a voltage of a first node and a voltage of a second node;

a second output circuit configured to supply a signal supplied to a fourth input terminal or the voltage of the second power source to a second output terminal in response to the voltage of the first node and the voltage of the second node;

an input circuit configured to control the voltage of the second node in response to a signal supplied to a first input terminal and a signal supplied to a second input terminal;

a first signal processor configured to control the voltage of the first node in response to the voltage of the second node;

a second signal processor configured to control a voltage of a third node in response to the signal supplied to the first input terminal, the second signal processor comprising a third capacitor connected between the first power source and the second node; and a third signal processor connected between the first node and the third node, the third signal processor being configured to control the voltage of the first node in response to an output voltage of the second signal processor and a signal supplied to a third input terminal, and wherein a capacitance of the third capacitor of the at least one third stage is greater than a capacitance of the third capacitor of each of the at least one first stage and the at least one second stage.

23. The display device of claim 22, wherein the capacitance of the third capacitor of the at least one third stage is greater than a sum of the capacitance of the third capacitor and a parasitic capacitance between the second node and the second output terminal of each of the at least one first stage and the at least one second stage.

24. The display device of claim 22, wherein the at least one third stage further comprises:

a first active layer comprising a source electrode and a drain electrode of at least one transistor;

a first conductive layer disposed on the first active layer, the first conductive layer comprising a gate electrode of the at least one transistor, a first electrode of at least one capacitor, and a first electrode of the third capacitor;

a second conductive layer disposed on the first conductive layer, the second conductive layer comprising the first output terminal and the second output terminal; and a second active layer disposed on the second conductive layer, the second active layer comprising a second electrode of the at least one capacitor.

25. The display device of claim 24, wherein the second active layer further comprises a second electrode of the third capacitor.

26. The display device of claim 24, wherein the second conductive layer further comprises a second electrode of the third capacitor.

27. The display device of claim 24, wherein the at least one third stage further comprises:

a third conductive layer disposed on the second active layer, the third conductive layer comprising the first input terminal, the second input terminal, and the third input terminal;

a planarization layer disposed on the third conductive layer, the planarization layer comprising an opening that, in a plan view, is positioned between the first input terminal and the third input terminal; and a fourth conductive layer disposed on the planarization layer, the fourth conductive layer comprising:

a first line configured to transmit the voltage of the first power source;

a second line configured to transmit the voltage of the second power source; and the fourth input terminal.

28. The display device of claim 27, wherein:

the first electrode of the third capacitor of the at least one third stage comprises a first extending portion overlapping the opening; and the second electrode of the third capacitor of the at least one third stage comprises a second extending portion overlapping the first extending portion.

* * * * *